US006537083B1

(12) United States Patent
Yatskov et al.

(10) Patent No.: US 6,537,083 B1
(45) Date of Patent: Mar. 25, 2003

(54) ELECTRICAL CONNECTOR ASSEMBLY FOR PRINTED CIRCUIT BOARDS

(75) Inventors: Alexander I. Yatskov, Kenmore, WA (US); Stephen V. R. Hellriegel, Bainbridge Island, WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/724,966

(22) Filed: Nov. 28, 2000

Related U.S. Application Data

(63) Continuation-in-part of application No. 09/705,387, filed on Nov. 3, 2000.

(51) Int. Cl.[7] ..... H01R 12/00
(52) U.S. Cl. ..... 439/67; 439/310
(58) Field of Search ..... 439/67, 310, 77

(56) References Cited

U.S. PATENT DOCUMENTS 4,470,100 A 9/1984 Rebaudo et al. ..... 361/413
4,907,975 A * 3/1990 Dranchak et al. ..... 439/493
4,913,656 A 4/1990 Gordon et al. ..... 439/67
4,931,022 A 6/1990 Neidich ..... 439/310
5,009,607 A 4/1991 Gordon et al. ..... 439/67
5,213,511 A 5/1993 Sobhani ..... 439/67

* cited by examiner

*Primary Examiner*—Gary Paumen
*Assistant Examiner*—Ann McCamey
(74) *Attorney, Agent, or Firm*—Seed IP Law Group PLLC

(57) ABSTRACT

A connector assembly for connecting the circuit paths on a printed circuit board to another printed circuit board. A casing has a flexible electrical connector positioned under it and coupled to a plurality of electrodes. The flexible electrical connector has conductive traces thereon. The flexible electrical connector extends around the casing, enters the top of the casing and terminates on electrodes in an intermediate circuit board. Individual shuttle flex strips are coupled to the intermediate circuit board and have traces thereon that are coupled to electrodes of the intermediate circuit board. The shuttle flex strips are coupled to a plurality of shuttles that can be moved forward to engage conductive pins in a receiver housing positioned on a second circuit board. In this way, the signal paths from one circuit board are coupled to another circuit board.

17 Claims, 17 Drawing Sheets

ELECTRICAL CONNECTOR ASSEMBLY FOR PRINTED CIRCUIT BOARDS

CROSS-REFERENCE TO RELATED APPLICATION

This application is a Continuation-in-part of U.S. patent application Ser. No. 09/705,387, filed Nov. 3, 2000, now pending, which application is incorporated herein by reference in its entirety.

This application is related to and claims the benefit of U.S. patent application Ser. No. 09/705,366, filed Nov. 3, 2000; U.S. patent application Ser. No. 09/705,368, filed Nov. 3, 2000; U.S. patent application Ser. No. 09/705,369, filed Nov. 3, 2000; U.S. patent application Ser. No. 09/705,386, filed Nov. 3, 2000; and U.S. patent application Ser. No. 09/724,790, filed the same day herewith, where these five co-pending patent applications are all incorporated herein by reference in their entireties.

TECHNICAL FIELD

This invention relates to a connector assembly for printed circuit boards and more particularly, to a connector assembly for electrically coupling the leads on one printed circuit board to the leads on another printed circuit board.

BACKGROUND OF THE INVENTION

In large computers, for example mainframes and super computers, many circuit boards are normally required. A single circuit board may have thereon a large number of integrated circuits, each of which may have hundreds of leads. A single printed circuit board, in a large and complicated circuit may therefore have several hundred, or perhaps thousands of electrical lead lines which carry data, address, control information and other discrete electrical signals. In such a large computer, it is necessary for the electrical signals of one printed circuit board to be transferred to another printed circuit lid 28 from the casing 26. After the connector assembly 22 is completely assembled and installed, as previously shown with respect to FIG. 4, the side circuit board 20 is ready for positioning within the framing for the housing of the supercomputer (not shown). Once circuit board 20 is positioned within the housing, then the individual shuttles 46 are advanced to align and mate with respective receiving assemblies 66 of the respective receiving connectors 36, which are described in detail herein with reference to subsequent figures.

FIG. 6 illustrates one embodiment of the bottom of the casing 26, with all connecting parts removed. Accordingly, FIG. 6 shows the casing 26 as a single, integral unit. As mentioned above, the casing 26 is preferably a molded plastic unit. However, the casing 26 is optionally manufactured as an assembly of parts. For example, the support ridges 100 are optionally molded as a separate unit and attached to form the casing 26.

A plurality of alignment prongs 58 are shown extending from the bottom surface of the casing 26. The alignment prongs 58 and the operation thereof are described in more detail in the co-pending patent application Ser. No. 09/705,386 and patent application Ser. No. 09/724,790. The alignment prongs 58 are preferably arranged with a plurality of prongs extending from the bottom of the casing 26 at a plurality of angularly spaced-apart positionts. For example, the alignment prongs 58 are preferably arranged with two sets of three prongs 58*a*, 58*b* and 58*c* project from either end of the elongated casing 26 with each set of prongs 58*a*, 58*b* and 58*c* preferably arranged at a plurality of relatively angularly spaced-apart positions. The alignment prongs 58*a*, 58*b* and 58*c* are preferably arranged with interstitial apertures between each of the three angularly spaced prongs 58*a*, 58*b* and 58*c*. The interstitial apertures are configured to mate closely with the prongs 58*a*, 58*b* and 58*c* projecting from a casing 26 positioned on the other side of the printed circuit board 20. The alignment prongs 58 are each formed with a support flange 126 around the top edge thereof adjacent to casing 26. Thus, when a connector assembly 22 is installed on a circuit board 20, the alignment prongs 58 are inserted into closely fitting holes formed in the board within the same computer. The connection between the printed circuit boards must be reliable while at the same time being easy to assemble.

In a complicated computer, the printed circuit boards are frequently at right angles with respect to each other. There may be many rows of printed circuit boards which run parallel to each other and, a number of other printed boards which run perpendicular to these printed circuit boards arranged in a row. The electrical connectors must therefore be of the type which permit easy, yet reliable and long-term connection between printed circuit boards which are perpendicular to each other.

SUMMARY OF THE INVENTION

According to principles of the present invention, a connector assembly is provided for coupling electrical leads on one printed circuit board to electrical leads on another circuit board. The connector assembly on a first printed circuit board includes a casing for retaining the electrical connector in the proper position. An electrical connector, such as a flex strip or other electrical ribbon connector is positioned within the connector assembly for carrying the signals from the first printed circuit board to another printed circuit board. A shuttle housing is connected to the first printed circuit board having a plurality of shuttles therein which contain the electrodes for connecting the electrical leads from the first printed circuit board to the second printed circuit board. The second printed circuit board has an electrical connector assembly thereon for coupling to the shuttle assemblies from the first printed circuit board. A connector assembly is also coupled to the second printed circuit board for transferring the electrical lines from the shuttle assembly to the electrical leads on the second printed circuit board. According to principles of the present invention, the connector assemblies are constructed in such a way as to provide protection for the electrical connectors which extend from the first printed circuit board to the second printed circuit board. The electrical connectors ale also held in a solid, retained position to ensure that they will be properly oriented when positioned on the printed circuit boards and moved into position to connect the printed circuit boards together or disconnected from the printed circuit boards.

The connector assembly includes a casing which is constructed to ensure that the electrical connector is always retained in a fixed position and maintains solid electrical contact from the printed circuit board to the shuttle assembly for transferring the signal line to the second printed circuit board. A plurality of alignment members are positioned on the connector assembly to ensure that the connector assembly is properly aligned with the circuit board and with the lead line on the printed circuit board. The connector assembly also includes a connector pad for ensuring reliable contact to the electrodes on the printed circuit board. It further includes a lid pressure pad and an internal circuit board for transferring the signal lines to the shuttle electrical connectors so as to carry the data from the printed circuit board to the shuttle assembly.

DETAILED DESCRIPTION OF THE INVENTION

In the Figures, like numerals indicate like elements.

Figure 1:
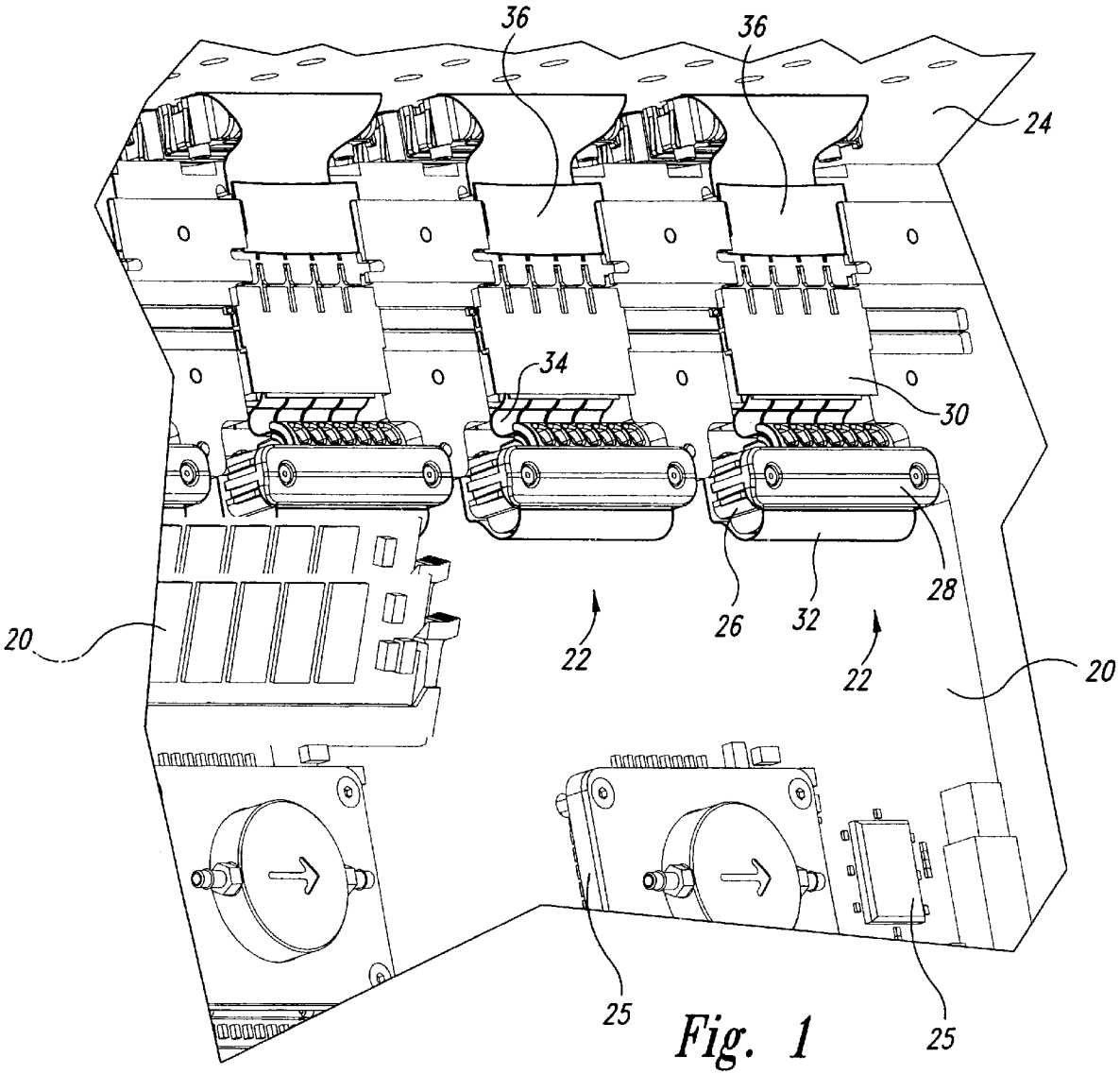
FIG. 1 is an isometric view of a printed circuit board prepared for electrical connection to another printed circuit board.

FIG. 1 shows a printed circuit board 20 having a plurality of connector assemblies 22 positioned thereon for connecting the printed circuit board 20 to another printed circuit board 24. According to one embodiment of the present invention, the circuit board 24 is a top plane board positioned above a row of parallel printed circuit boards 20 (not shown). The top plane 24 does not have any integrated circuits, chips, or other active electrical components thereon. Rather, it contains a large number of metallic interconnection lines for carrying signals from one circuit board 20 to another circuit board 20. In an alternative embodiment, each of the printed circuit boards 20 and 24 may include thereon a large number of integrated circuit chips. Among the integrated circuits coupled to the printed circuit boards 20 and 24 may be microprocessors 21, memory chips 23, and other integrated circuits 25 which may be used in a large mainframe computer. Such integrated circuits, of necessity, have a large number of lead lines. For example, in some recent integrated circuit designs, the number of lead lines are in the hundreds, and may, in some instances, be in the thousands. Many of these carry individual data, address information, or other signals. These signal lines are connected from the integrated circuit to lead lines within the printed circuit board, extend to the end of the printed circuit board 20, and have exposed electrode terminals for coupling to the electrodes on the connector assembly. A single connector assembly may carry several hundred individual data paths from the printed circuit board 20 to the printed circuit board 24. Because of the compact nature of the lead lines on the printed circuit board 20, the electrodes must also be compact, having a close spacing. In order to ensure proper transfer of the signal from one printed circuit board to another, the connections must be made reliable, and withstand, over a long period of time, the rigors of operation in a harsh environment, which may be subject to thermal cycling as the large mainframe computer heats and cools, and may also be subject to other harsh conditions during operation.

The electrical connector assemblies include a connector casing 26, a lid 28, and a shuttle assembly 30. The connector assembly 22 also includes a connector flex strip 32 for carrying the electrical signal traces to the shuttle flex strips 34 which are connected inside the shuttle assembly 30. Alternatively, as described below, connector flex strip 32 are formed integrally with shuttle flex strips 34 as a single flex strip.

The top plane printed circuit board 24 also includes a receiving assembly 36 for connecting to the individual shuttle connectors within the shuttle assembly 30 mounted on the side plane circuit board 20. The top plane printed circuit board 24 contains a number of connectors, and may, in some embodiments, also include integrated circuits for receiving the signal paths and performing certain operations or for transferring them to other electrical circuit boards within the mainframe computer. According to another embodiment of the present invention, the top plane printed circuit board 24 contains no integrated circuits but instead, contains a plurality of electrical traces which transfer the signal paths from one side plane printed circuit board 20 to another side plane printed circuit board 20, positioned parallel to each other. Since a row of side plane printed circuit boards 20 are connected to a single top plane circuit board 24, the signal paths are carried from one printed circuit board 20 to another printed circuit board 20 via electrical traces contained within top plane printed circuit board 24. Circuit board 24 can be a back plane circuit board, another main circuit board 20 or any board to which electrical connection is desired.

Figure 2:
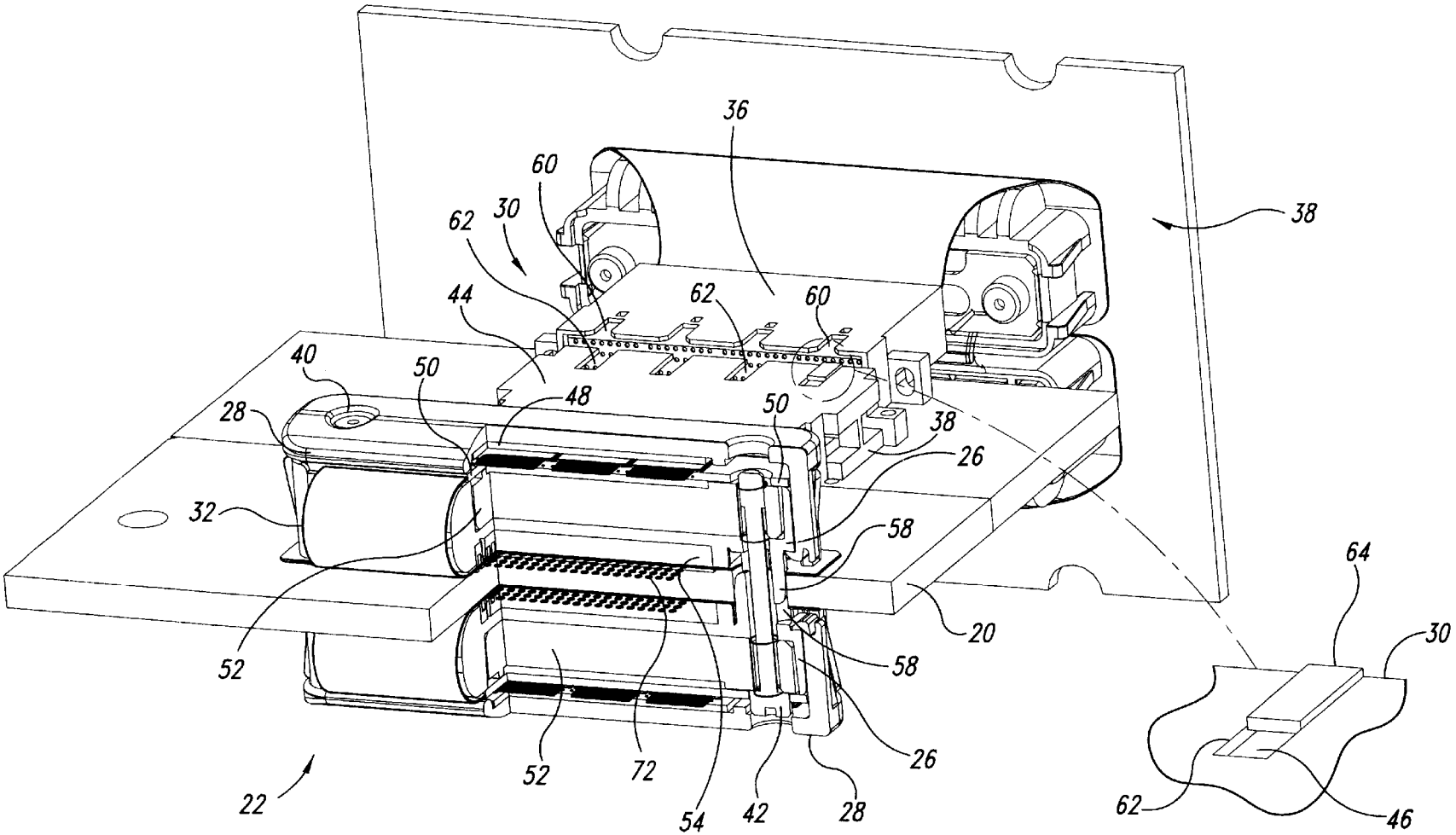
FIG. 2 is a partial cutaway view of the connector assembly of the present invention.

FIG. 2 is a partially cut-away pictorial view showing a single electrical connector assembly 22 on the side plane printed circuit board 20 coupled in position for coupling to a connector assembly 38 on the top plane circuit board 24. The side plane connector assembly 22 is coupled to circuit board 20 and carries electrical signal lines to the shuttle assembly 30. Circuit board 20 has integral electrical traces thereon for carrying electrical signals. However, the electrical traces are not part of the present invention and are omitted for clarity in the Figures. The connector assembly 22 includes an aperture 40 for receiving a threaded fastener or screw 42, which extends therethrough for connecting it to the printed circuit board 20. The connector assembly 22 also includes the connector flex strip 32, which extends underneath the connector casing 26 and contacts the electrical terminals positioned on the printed circuit board 20. The connector flex strip 32 contains individual electrical traces (omitted from the Figures for clarity) for providing an electrical signal path from the individual terminals on the printed circuit board 20 to the shuttle assembly 30. The shuttle assembly 30 includes a shuttle housing 44 having a plurality of individual shuttles 46 contained therein, as best shown in subsequent FIGS. 7, 17 and 18. As discussed in detail below, each individual shuttle 46 is movable from a first position inside shuttle housing 44 to a second position in which it extends into the receiving assembly 36 and makes electrical connections therewith.

As described in greater detail below, connector assembly 22 includes a lid pressure pad 48 on an underside of lid 28. A compressive clamping force applied by the lid 28 is evenly distributed by the lid pressure pad 48 to a plurality of electrical connectors captured between the connector casing 26 and the lid 28. Aperture 40 extends through the lid 28 permits the passage of a threaded fastener 42. A transfer circuit board 50 couples the electrical traces on the connector flex strip 32 to corresponding traces on the shuttle flex strips 34, shown in FIG. 1. A stiffener bar or plate 52 is positioned within the connector casing 26 underneath the transfer circuit board 50. The stiffener bar 52 provides rigid support and solid connection within the electrical connector assembly 22 as explained later herein. In the bottom portion of the case 26 opposite the lid 28 is positioned a connector pressure pad 54. The connector pressure pad 54 is positioned to provide constant, uniform pressure to electrodes 56 on the bottom surface of the connector flex strip 32 to maintain low-resistance, reliable contact to the electrodes on the printed circuit board 20.

One or more fasteners 42 extend through respective apertures in the stiffener bar 52 and the casing 26 on one side of the printed circuit board and into respective apertures in another connector casing 26 and a corresponding stiffener bar 52 of another connector assembly 22 coupled to the other side of the printed circuit board 20. Each fastener 42 is preferably threaded into mating threads formed in the corresponding stiffener bar 52 and secured with sufficient torque so as to maintain the connector assembly 22 in proper alignment for long periods of time. The torque is selected so as to provide uniform pressure and solid electrical contact in combination with the connector pressure pad 54 and the remaining portions of the connector assembly 22. The amount of torque selected for the fasteners 42 is sufficiently great to ensure solid, reliable electrical connection without degrading the electrical or mechanical properties of the respective connectors 22 or the printed circuit board 20.

A plurality of alignment prongs 58 are also positioned on the case 26 for aligning the case 26 relative to respective apertures in the printed circuit board 20. Prongs 58 also properly align the electrical connector 22 on one side of the printed circuit board 20 to the electrical connector assembly 22 on the other side of the printed circuit board 20. The details of the alignment prongs are shown, and explained in more detail with respect to FIGS. 6–7 herein.

The stiffener bar 52 is preferably formed of a metal, or another suitable material for threadably engaging and securing the fasteners 42. The stiffener bar 52 preferably includes threads formed in the aperture through which the fastener 42 extends. Accordingly, the stiffener bar 52 acts to rigidly secure the entire connector assembly 22 in a predetermined position on the printed circuit board when interconnected with the fastener 42 extending therethrough. The stiffener bar 52 also provides additional functions as explained later herein.

According to various embodiments of the invention, connector assemblies 22 are positioned in an aligned, mating relationship on both sides of the printed circuit board 20. In other embodiments of the invention, the connector assembly 22 is positioned on only one side of the printed circuit board 20 and an appropriate fastener assembly, or nut (not shown) is positioned on the other side of the printed circuit board 20. Thus, the fasteners 42 may be threaded through respective nuts rather than being threaded through a stiffener bar 52 of another electrical connector. Alternatively, another suitable fastening means is used with the fasteners 42 to securely couple the connector assembly 22 to the printed circuit board 20 in proper alignment.

Figure 4:
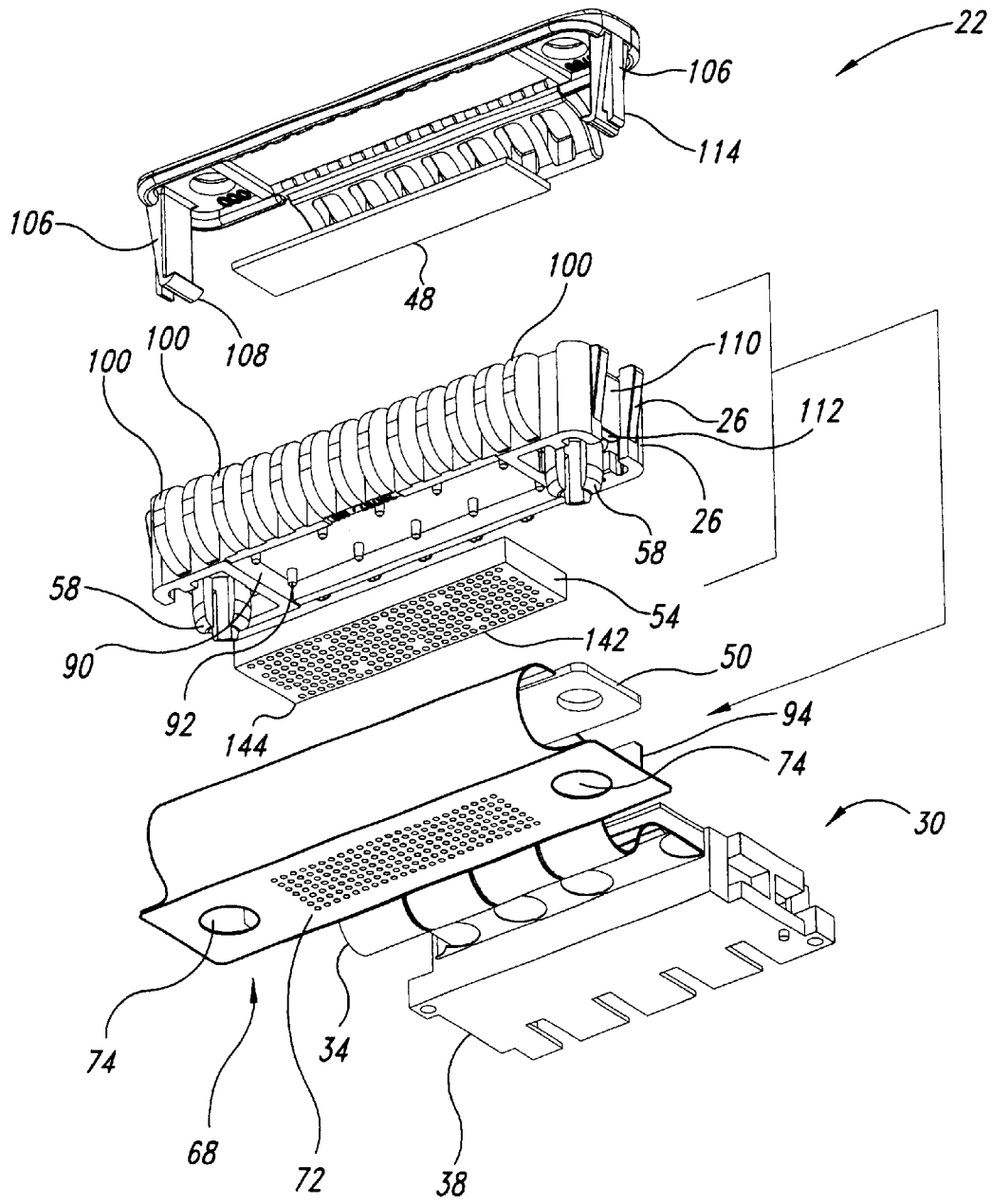
FIG. 4 is an exploded view one embodiment of the connector assembly of the present invention from the bottom back side.

FIG. 2 also provides a pictorial view of the receiving assembly 36 as positioned to receive the individual shuttles 46 within the housing 44 of the shuttle assembly 30. Slots 60 in the receiving assembly 36 are shown aligned with corresponding slots 62 in the shuttle housing 44. In FIG. 4, only one surface of shuttle 46 is shown within the shuttle housing 44. An alignment tab 64 is shown projecting from the surface of the shuttle 46. As will be appreciated, alignment tabs 64 extending from the individual shuttles 46 align the shuttles 46 with the respective slots 62. As the shuttle 46 advances from the housing 44, the alignment tab 64 slides into corresponding slot 60 and assists to align and mate the shuttle 46 with the connector 66 within the receiving assembly 36.

Figure 3:
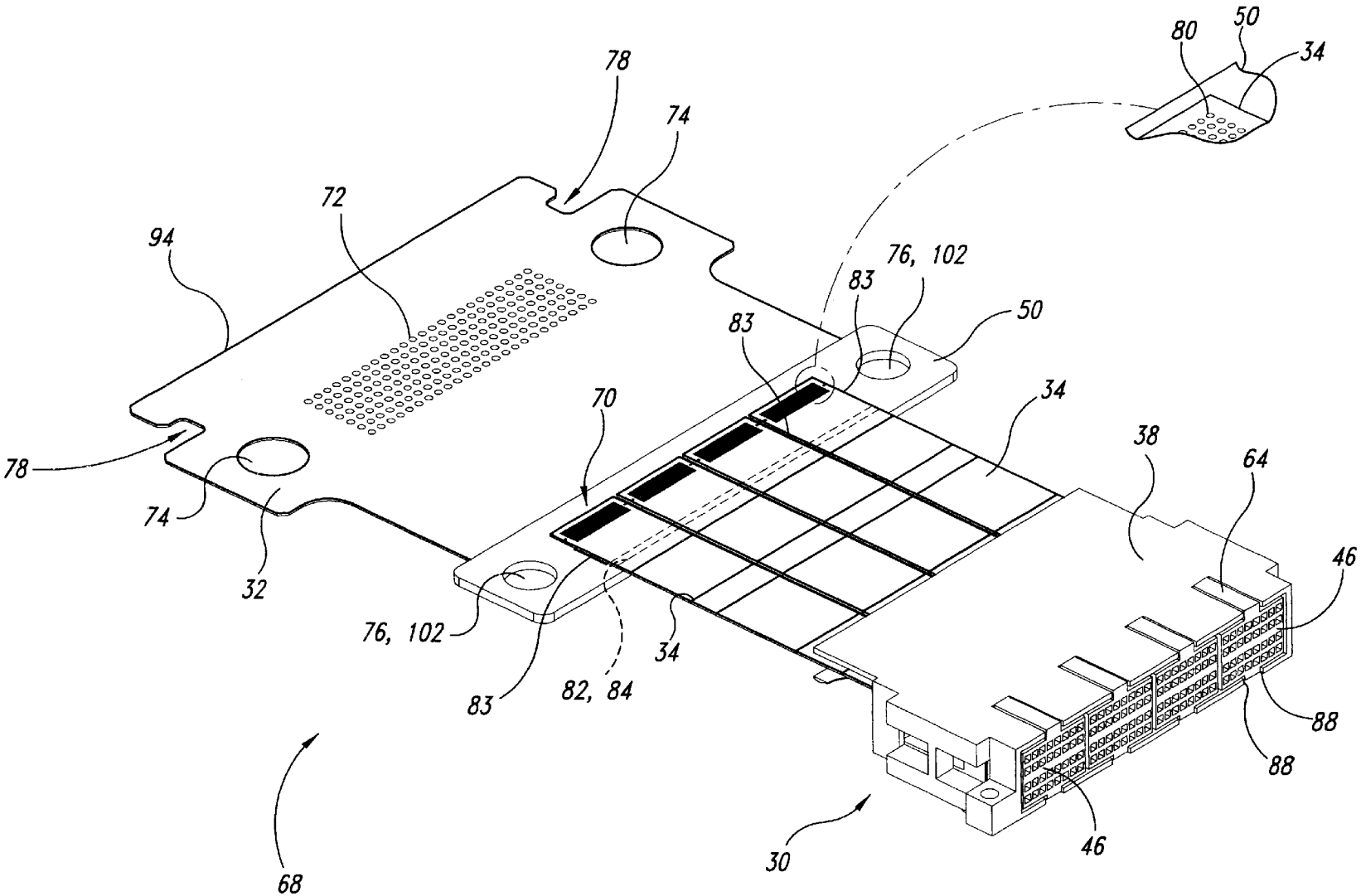
FIG. 3 is an isometric view of the connector flex strip and the shuttle flex strips of the present invention connected to each other in the intermediate circuit board of the present invention.

FIG. 3 illustrates an electrical signal path assembly 68, which according to principles of the present invention, is assembled prior to being positioned within and as a part of the connector assembly 22. The electrical signal path assembly 68 includes connection subassembly 70, which in turn includes the connector flex strip 32 coupled to the intermediate transfer board 50 and having the individual flex strips 34 connected thereto. The connector flex strip 32 is formed as a single element having electrical traces (not shown) appropriately insulated and terminated in exposed electrodes 72 thereon, as described in greater detail in above incorporated co-pending patent application Ser. No. 09/705,368.

According to the principles of the present invention, the circuit board 20 is provided with a plurality of disc shaped contact pads. The pads are formed concurrently with the formation of other features of the circuit board, by employing known manufacturing techniques. The flex strip 32 is formed of a piece of flexible circuit material of a size and shape required for the particular application. In one embodiment of the invention, this flexible circuit material, or "flex" is a composite of materials commercially available, i.e. Dupont Pyralux Series. The exposed electrodes 72 formed on the flex strip 32 are contact pads formed with a spacing and configuration to match those on the circuit board 20.

The electrode contact pads 72 are formed on the circuit material in a manner such that each pad has a plurality of tiny bumps, or micro-pads, on the surface. When the connector assembly 22 is placed in correct alignment relative to the contact pads on the circuit board 20, and modest pressure is applied, solid, low-resistance electrical contact is achieved between each electrode 72 on the connector and each corresponding pad on the circuit board 20.

The connector flex strip 32 also contains registration holes 74 and 76 for alignment with the casing 26 and notches 78 for securing the alignment. The connector flex strip 32 is coupled to electrodes in the intermediate transfer board 50 by the appropriate electrical connections using techniques known in the art. Optionally, the connector flex strip 32 is positioned flat and firmly positioned while being connected the intermediate transfer board 50.

The individual flex strips 34 may contain numerous, for example, hundreds of individual electrodes 80 each of which is connected to the appropriate electrode of the connector flex strip 32. The individual flex strips 34 are properly connected to the appropriate corresponding electrodes on connector flex strip 32, either directly or via traces within the intermediate transfer board 50. The intermediate transfer board 50 therefore provides a miniature circuit board for providing proper electrical connections between the two flex strips, the connector flex strip 32 and the shuttle flex strips 34, via a plurality of electrical terminals on opposing surfaces thereof. Accordingly, the individual flex strips 34 are each aligned and coupled with electrical terminals on a top surface of the intermediate transfer board 50 opposite from the connector flex strip 32, which correspond to electrical terminals on the opposing bottom surface that are coupled to the electrodes from the connector flex strip 32.

The aligned flex strips 34 are secured to the intermediate transfer board 50. For example, the flex strips 34 are secured by all adhesive strip 82, shown as dashed lines. The adhesive 82 may be any acceptable adhesive for connecting a flexible connector to a rigid circuit board. Since the strips 34 are insulated at the point of connection, preferably with a temperature resistant material such as Kapton®, a thin bead of solder may be used. Since solder may be available during this assembly process, it may provide a simple and low-cost adhesive for holding the individual flex strips 34 to the intermediate transfer board 50. Alternatively, any other suitable adhesive or connection is used. For example, in one embodiment, another suitable adhesive 84 is used in place of or in addition to the solder connection 82. The adhesive 84, shown in dashed lines, holds the individual flex strips on the intermediate transfer circuit board 50. The adhesive 84 may be any acceptable adhesive, such a glue, cement, a solder, or another adhesive which holds the individual flex strips 34 in the proper position and relieves the stress on the electrodes 80 at the connection point to the electrical terminals on the intermediate transfer circuit board 50. Adhesive or some additional support and stress relief may be provided at locations 83 in addition to or instead of at locations 84.

The individual flex strips 34 also include electrodes 86 (shown in FIG. 14) appropriately connected to the corresponding shuttle 46, which provides an electrical signal path to electrical contacts within each individual shuttle 46. For example, the electrodes 86 are coupled to corresponding receptacles 88 within each individual shuttle 46. The shuttles 46 are also positioned within the shuttle housing 44 with the tabs 64 of each individual shuttle 46 properly aligned in a respective slot 62. According to one embodiment of the invention, the electrical signal path assembly 68 is now prepared for connection to the casing 26.

Alternatively, the electrical signal path assembly 68 is formed in a single, integrated flex print 68 by the methods described above and otherwise known in the art. The single, integrated flex print 68 includes a portion corresponding the connector flex strip 32 and additional portions joined therewith and corresponding to the individual flex strips 34. The portion corresponding the connector flex strip 32 is formed with electrical traces appropriately insulated and terminated in exposed electrodes 72 thereon. The portions corresponding to the individual flex strips 34 are formed with electrical traces appropriately insulated and terminated in electrodes thereon and coupled to corresponding receptacles 88 within individual shuttles 46. The appropriate signal paths between termination electrodes 72 on the connector flex strip 32 portion and electrical receptacles 88 are formed by the electrical traces within the integrated flex print 68.

Figure 5:
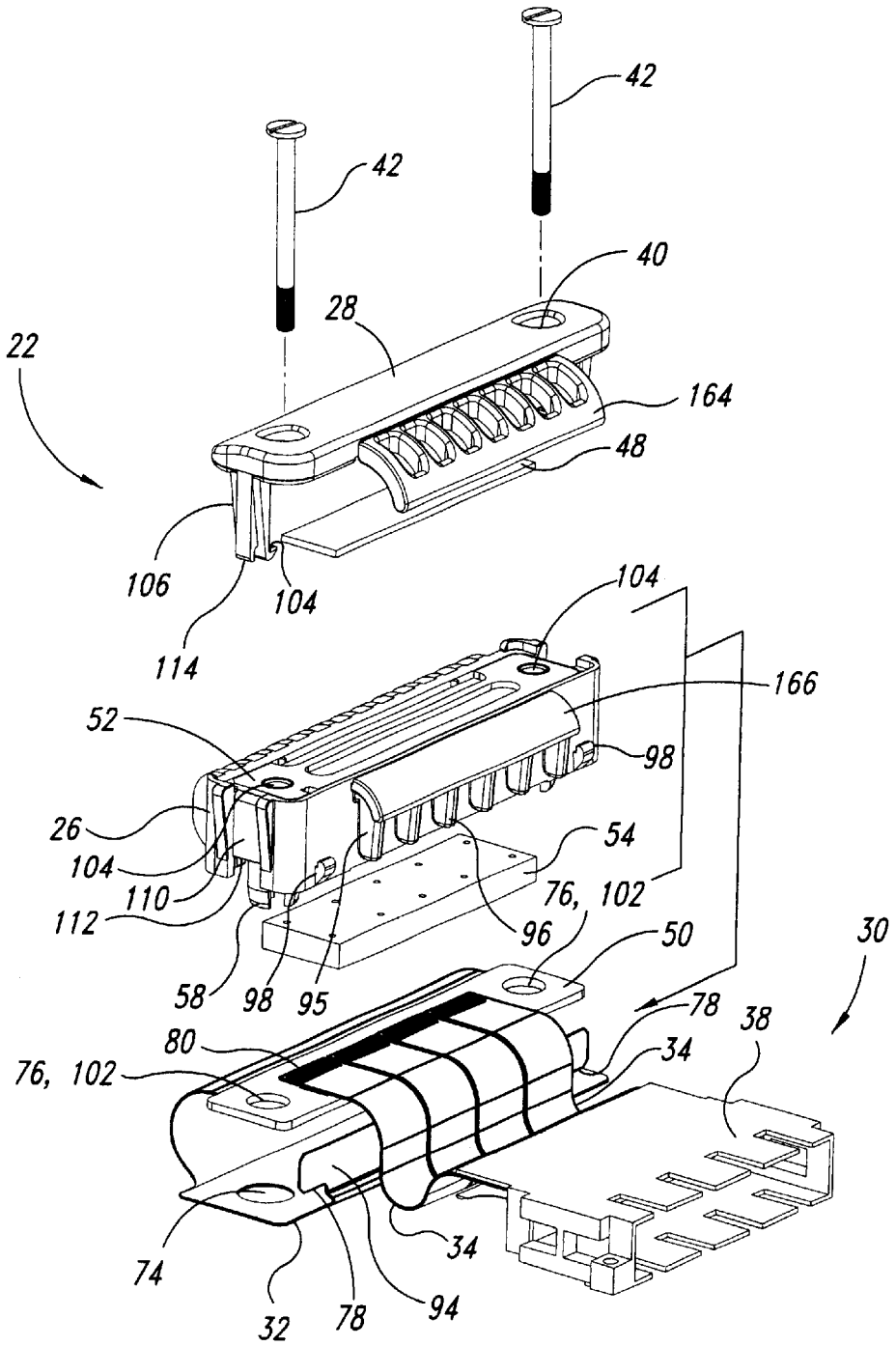
FIG. 5 is a top exploded view showing one embodiment of the connector assembly of the present invention.

FIGS. 4 and 5 are both exploded views of the assembly and together generally illustrate the assembly of electrical signal path assembly 68 into connector assembly 22. FIG. 4 is an exploded view from the bottom back side of the connector assembly 22 and shuttle assembly 30, while FIG. 5 shows a top exploded view of the entire connector assembly, with the individual components exposed for ease in viewing. Greater detail of both the subassembly steps and individual components is provided below.

On a bottom or underside of casing 26, a recess 90 is provided, the recess 90 having a plurality of pegs 92 formed on a bottom surface thereof and projecting perpendicularly downwardly therefrom. The pegs 92 secure the connector pressure pad 54 within the recess 90. The individual electrodes 72 on the connector flex strip 32 are positioned on an underside of the casing 26 outside of the pressure pad 54. A plurality of alignment prongs 58 mate with registration holes 74 in the connector flex strip 32 to align the connector flex strip 32 both with pressure equalization holes in the pressure pad 54 and for contact with corresponding electrodes on the printed circuit board 20 when the connector assembly 22 is connected to the printed circuit board 20. For assembling the electrical signal path subassembly 68 to the casing 26, a front flap 94 of the connector flex strip 32 is bent at about a 90 degree angle and is extended into recesses 95 underneath the retaining flanges 96 of the casing 26, as described in greater detail below. After the front flap 94 is positioned underneath the retaining flanges 96 and the notches 78 are fitted over one or more hooks 98 on the sidewall of the casing 26, the connector flex strip 32 is extended underneath the casing 26 into alignment with individual electrodes 72. The retaining flanges 96 and hooks 98 secure the alignment of electrodes 72. The electrical signal path subassembly 68 wraps around the casing 26 to a top portion thereof. A plurality of support ridges 100 preferably extend across the entire back wall of the casing 26. As the signal path subassembly 68 wraps around the casing 26, one or more support ridges 100 orient the connector flex strip 32 to insure that individual traces within the flex strip 32 are not damaged and that it does not twist or bend into an undesirable position. The intermediate transfer board 50 is positioned inside of the casing 26 at its top, then the intermediate board 50 is pressed to fit down into a recess in the casing 26 on top of, and supported by the stiffening bar 52. Registration holes 76, 102 within the connector flex strip 32 and the intermediate transfer board 50, respectively, are aligned with corresponding threaded holes 104 in stiffening bar 52 to accept the fasteners 42 therethrough.

The lid 28 includes arms 106 extending therefrom on either end, the arms 106 having clips 108 thereon for securing the lid 28 to the connector casing 26. The lid 28 is snapped into position on the top of the casing 26 over the intermediate transfer board 50 of the signal path subassembly 68. Thus, the lid pressure pad 48 is on top of the intermediate transfer board 50. The clips 108 each extend into a recess 110 along the edge of the case and engage with a flange 112 positioned at the bottom of recess 110. As previously stated, a lid pressure pad 48 is positioned between the lid 28 and the rigid transfer board 50 to insure solid, uniform electrical contact between the electrode terminals, individual terminals 80 of the shuttle flex strips 34 and corresponding electrodes of the connector flex strips 32. The arms 106 also include release flanges 114 for disengaging the clips 108 from the flanges 112 by an outward force exerted thereon, which disengages the circuit board 20. For example, the prongs 58 and the holes in the circuit board 20 are matched to have a conventional slip fit, interference fit, or press fit.

Furthermore, when two connector assemblies 22 are mated to opposite sides of a circuit board 20, as shown in FIG. 2, the three angularly spaced prongs 58*a*, 58*b* and 58*c* fit into the slots formed between and defined by the prongs 58 to interleave with the three angularly spaced prongs 58*a*, 58*b* and 58*c* projecting from the housing 26 of the mating connector assembly 22 on the other side of the circuit board 20.

The recess 90 provided on the bottom side of the casing 26 is defined by a bottom surface 130 surrounded by a plurality of side walls 128. A plurality of pegs 92 formed on the bottom surface 130 thereof project perpendicularly outwardly therefrom.

Figure 7:
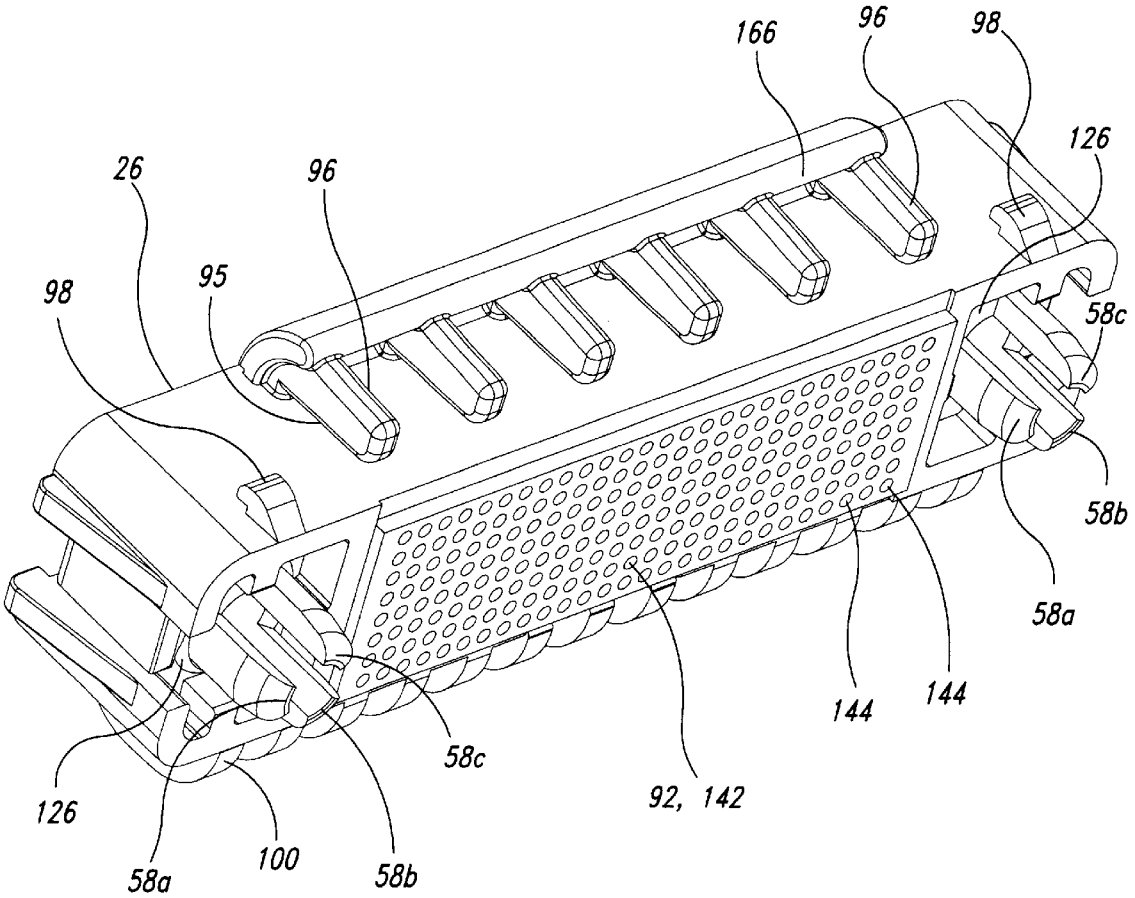
FIG. 7 is a bottom side view of the connector assembly of the present invention showing the connector pressure pad and alignment prongs.

FIG. 7 shows the bottom side of the casing 26 with the pressure pad 54 installed. The plurality of pegs 92 projecting from the bottom surface of recess 90 in casing 26 are inserted into corresponding undersized passages 142 formed through pressure pad 54. The pegs 92 are oversized relative to the corresponding undersized passages 142. The connector pressure pad 54 is therefore press fit and held securely within the recess 90 in the bottom surface of the casing 26. Side walls 128 are also preferably sized to secure to the pressure pad 54. The pressure pad 54 protrudes sufficiently from the recess 90 beyond the extremes of the casing 26 so that significant compression occurs when the connector assembly is secured by fasteners 42 to the circuit board 20.

The connector pressure pad 54 also has, in a bottom surface thereof, a plurality of pressure equalization apertures 144 for providing an even pressure against the electrodes in the bottom surface of the connector flex strip 32, as described in greater detail in the co-pending application Ser. No. 09/705,366.

Figure 9:
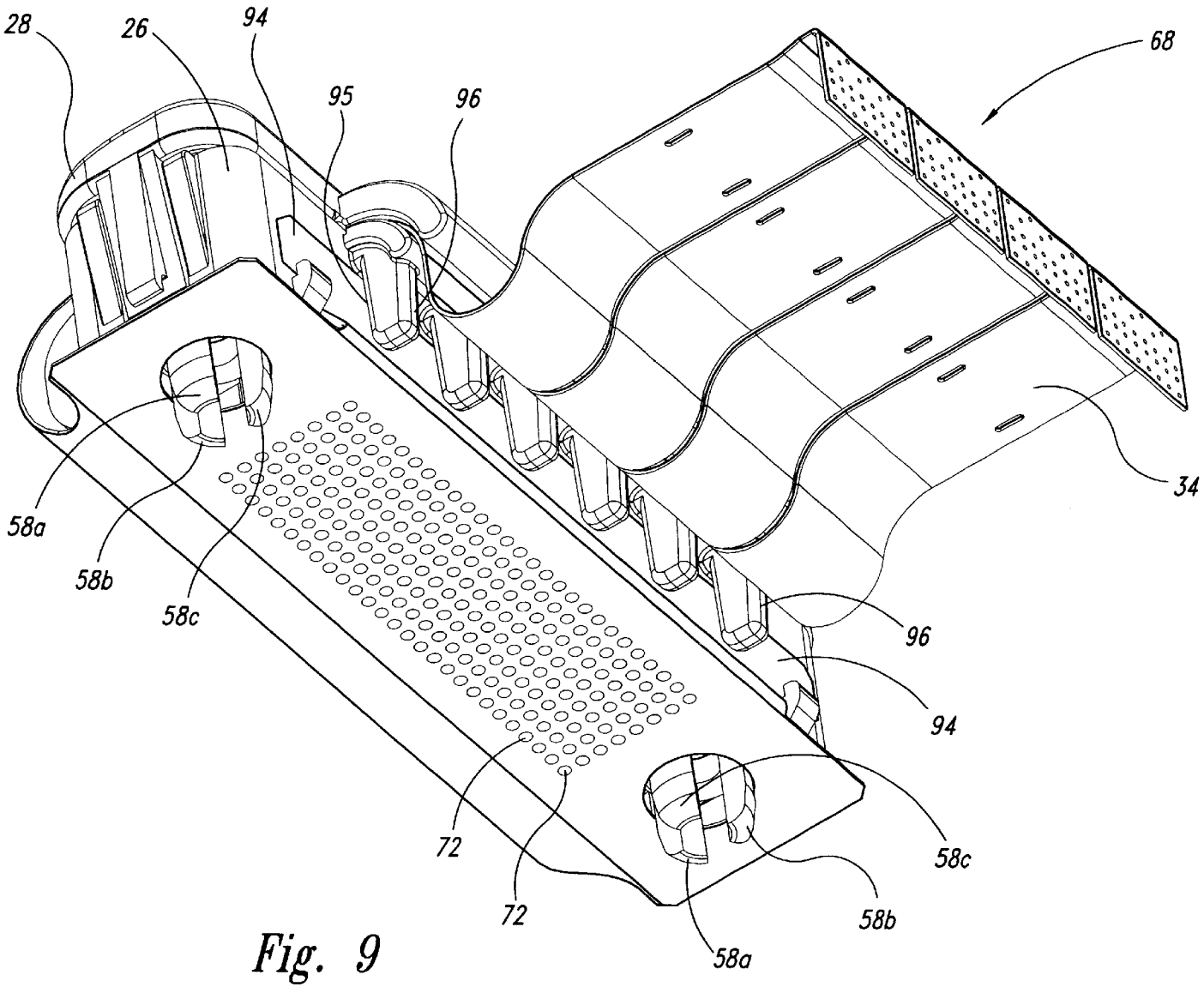
FIG. 9 is an isometric view from the bottom of the connector assembly of the present invention.
Figure 10:
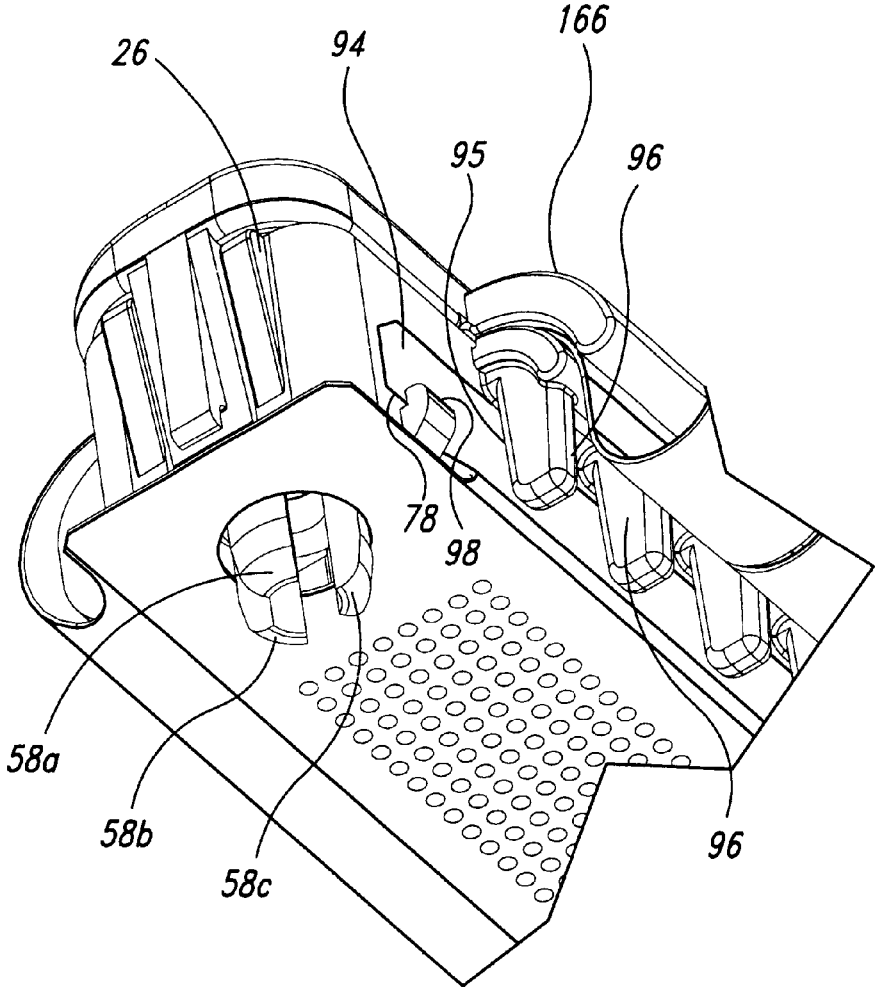
FIG. 10 is an enlarged view of the casing of the present invention having the connector flex strip positioned therein.
Figure 13:
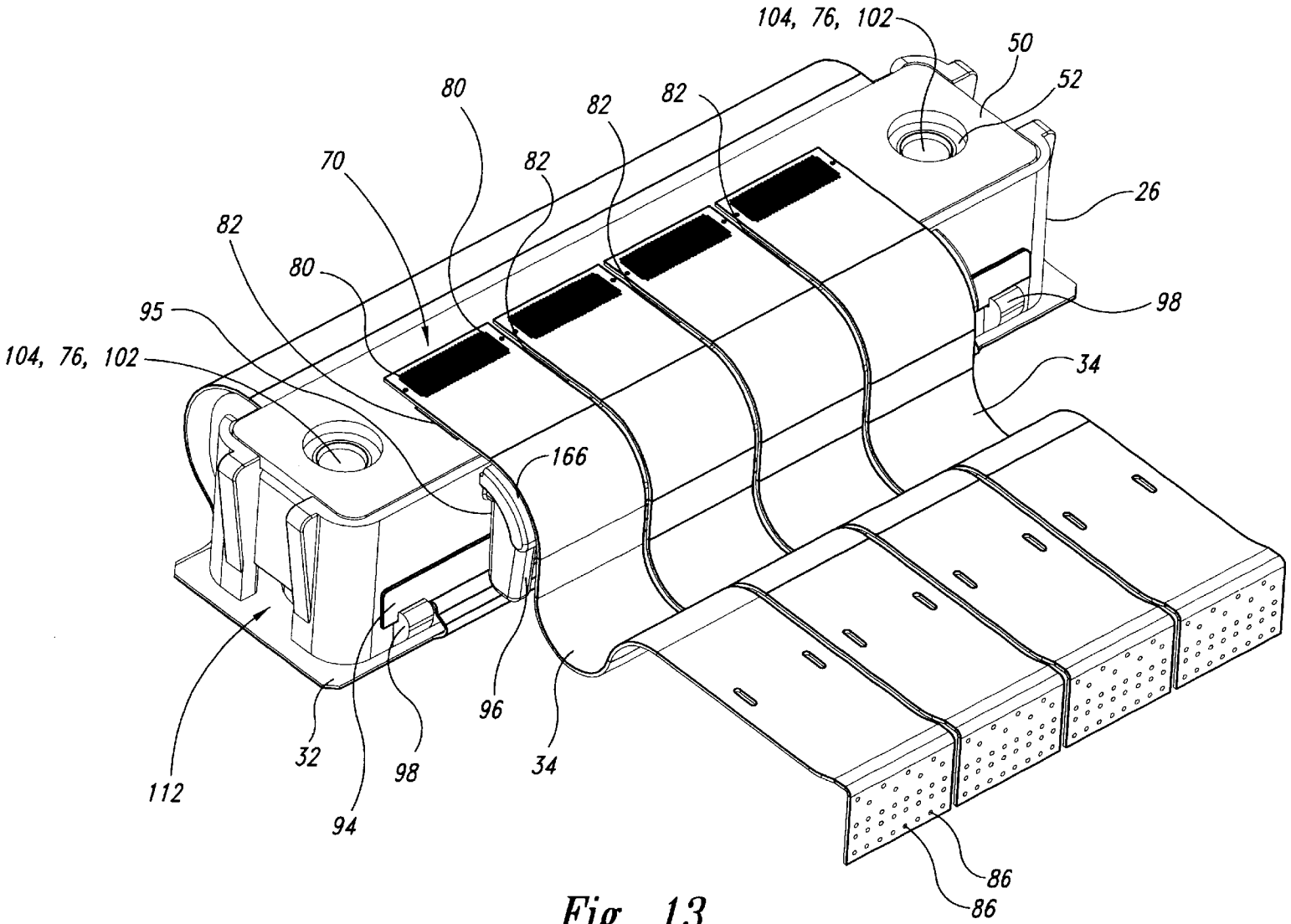
FIG. 13 is an isometric view of one embodiment of the casing of the present invention with the connector flex strip and the shuttle flex strips connected to each other within the casing.

One or more retaining flanges 96 extend across substantially the entire front surface of the casing 26. The retaining flanges 96 are spaced away from the sidewall of casing 26 to form a recess 95 between the flanges 96 and the front sidewall of the casing 26. The folded front edge 94 of the connector flex strip extends into this recess 95, as best shown in FIGS. 9, 10 and 13. Also positioned on the front of the casing 26 are one or more hooks 98, preferably formed as a pair of spaced-apart hooks 98. A hole, a flap, or a notch 78 extending from the front flap 94 of the connector strip 32 is engaged by each hook 98 to firmly secure the front flap 94 within the recesses 95.

Figure 8:
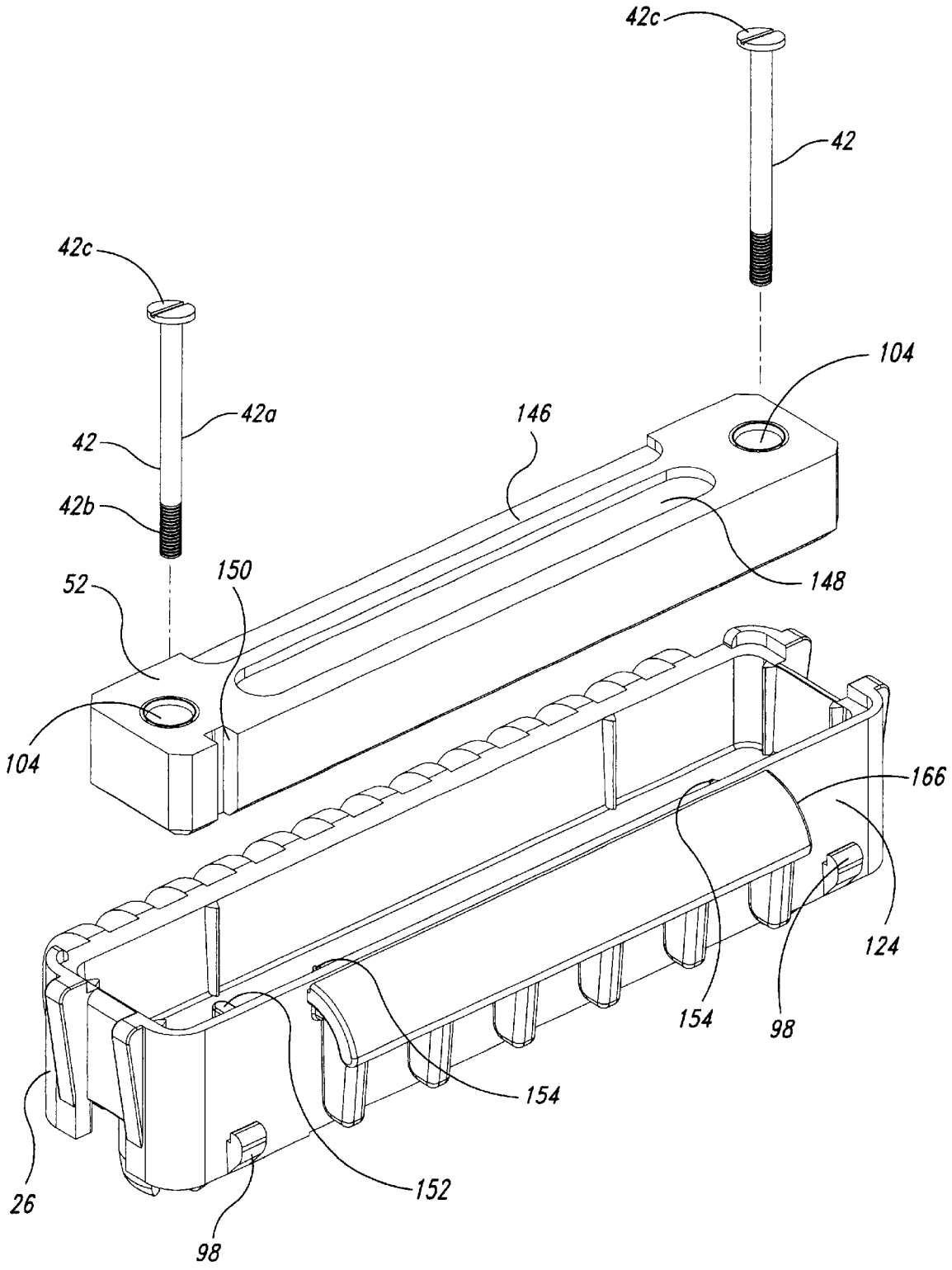
FIG. 8 is an exploded view of one embodiment of the casing and stiffener bar of the present invention.

FIG. 8 illustrates one embodiment of a casing 26 and the stiffener bar 52. The stiffener bar 52 is preferably composed of a rigid metal, such as aluminum, steel or another suitable rigid material in which threaded apertures 104 are formed for receiving threaded fastener 42, as shown in the previous figures. The threaded fasteners 42 are preferably formed with a necked-down shaft 42*a* between a full-diameter threaded portion 42*b* and a head 42*c*. The necked-down shaft 42*a* is sized to pass freely through the threaded holes 104 in stiffener bar 52, while the full-diameter threaded portion 42*b* threads into either another connector assembly 22 or a nut on the other side of the circuit board 20 (see for example, FIG. 15).

The stiffener bar 52 includes recesses 146 and 148 in the top surface thereof. The recesses 146 and 148 are positioned with respect to the underside of intermediate transfer board 50. As will be appreciated, intermediate transfer board 50 contains, on a bottom surface thereof a plurality of electrical terminals. The electrical terminals are desirably not shorted together since each represents a signal path from one printed circuit board to another printed circuit board. According to the embodiment wherein the stiffener bar 52 is formed of metal, insurance of electrical insulation between electrodes on the intermediate transfer board 50 and the stiffener bar 52 is necessary. One technique for providing this electrical insulation is to form recesses 146 and 148 at all those locations where a potential exists for contact with the electrodes. Other techniques may be used, for example, placing a layer of insulation on the underside of the intermediate transfer board 50 to insure that even though the intermediate transfer circuit board 50 may contact metal stiffener bar 52, none of the leads are shorted to each other. In another example, an insulating layer is placed on the top surface of the stiffening bar 52. Other suitable insulating techniques are also contemplated by the invention.

Stiffening bar 52 is preferably precisely shaped and sized to fit in the precipice between the casinos 26 with a known orientation. Accordingly, the stiffener bar 52 includes an orientation slot 150 which aligns with a flange 152 on an interior surface of the casing 26. Furthermore, various standing ridges 154 within the casing 26 interior contact and engage the stiffener bar 52. Thus, the stiffener bar 52 is held in a rigid, fixed position relative to the casing 26 and also acts to stiffen and support casing 26.

According to a preferred embodiment of the invention, the casing 26 is not independently responsible for alignment of the electrical connections. Therefore, the stiffness and dimensional tolerances of casing 26 are not unduly critical. Accordingly, casing 26 is preferably formed of a molded plastic material, such as an injection moldable plastic, and is inexpensive to manufacture. The stiffener bar 52 is manufactured to provide the proper alignment tolerances. Furthermore, when positioned inside the casing 26, the stiffener bar 52 provides shaping for the entire connector assembly 22. The stiffener bar 52 and casing 26 interact to provide an integrated connector assembly 22 having appropriate stiffness and dimensional tolerances. The stiffening bar 52 is threadedly secured to the circuit board 20 and thereby maintains the casing 26 and the electrodes 72 of the connector flex print 32 in an electrically coupled, fixed relationship with the circuit board 20. The stiffening bar 52 simultaneously provides a solid, rigid support for the intermediate transfer circuit board 50 while providing the stiffness needed to ensure the uniform pressure to the connector pressure pad 54 mounted in the bottom of the casing 26 for mating the electrodes 72 of the connector flex print 32 with corresponding electrodes on the circuit board 20. The two-part integrated assembly therefore provides significant cost saving in the manufacture while providing high reliability within useful tolerances for connection to the printed circuit board 20.

FIG. 9 shows the underside of the connector assembly 22 with the signal path subassembly 68 installed, including connector flex strip 32. The electrodes 72 on the connector flex strip 32 connect to individual traces within the connector flex strip 32, and thus carry the electrical signal path from the printed circuit board 20 into the respective traces of the connector flex strip 32. Registration holes 74 in the connector flex strip 32 mate with the alignment prongs 58 to ensure that the connector flex strip 32 is properly aligned with respect to the casing 26 and thus with corresponding electrodes on the printed circuit board 20.

Alignment prongs 58 align the electrodes 72 on connector flex strip 32 with respect to pressure equalization apertures 144 formed on pressure pad 54. The individual electrodes are arranged in contact with the resilient pad material of pressure pad 54 at the interstitial positions between each grouping of pressure equalization apertures 144. As described in greater detail in the co-pending application Ser. No. 09/705,366, pressure equalization apertures 144 collapse slightly when connector assembly 22, with connector flex strip 32 placed, is secured to the circuit board 20. Simultaneously, the pressure pad 54 is peripherally supported by contact with the rigid side walls 128 of the recess 90 into which the pressure pad 54 is installed. Thus, the peripheral support of side walls 128 combine with the slight collapse of the pressure equalization apertures 144 peripheral to and surrounding each electrode 72 to equalize the contact pressure across all of the electrodes 72 when the pressure pad 54 is compressed as the connector assembly 22 is firmly secured to the circuit board 20.

FIG. 10 is an enlarged view showing the hook 98 engaging the flap 94 of the connector strip 32 at notch 78. The flap 94 also extends into the recesses 95 under the flanges 96 and is retained in a fixed relationship to casing 26.

Figure 11:
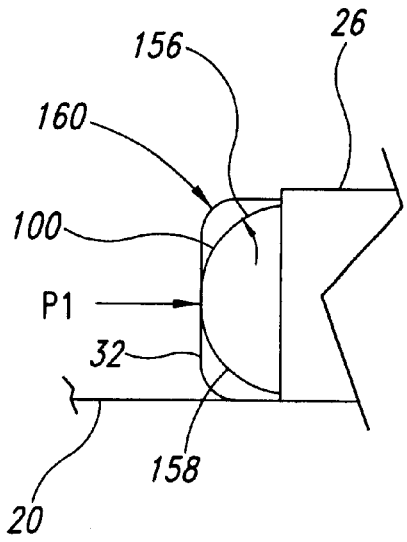
FIG. 11 illustrates the operation of strain relief ridges of the present invention that provide strain relief for a connector flex strip.

FIG. 11 illustrates the operation of strain relief ridges 100, which provide strain relief for connector flex strip 32 where it wraps around the casing 26 from the bottom surface thereof to the top. Strain relief ridges 100 are each a combination of at least two curving surfaces 156 and 158 that together define a semicircular surface. Connector flex strip 32 is formed in a semicircular arch between opposing surfaces of casing 26. For example, connector flex strip 32 is formed having one end interconnected to circuit board 20 beneath casing 26 and the other end connecting with shuttle flex strip 34 via intermediate transfer board 50 situated at the top of connector 26 opposite from circuit board 20. Each of the connector flex strip 32 and the strain relief ridges 100 are configured with a surface length such that, in a condition where a connector flex strip 32 is constrained relative to strain relief ridges 100, a gap 160 is formed therebetween. Furthermore, the relative semicircular lengths of the connector flex strip 32 and the strain relief ridges 100 are configured such that gap 160 therebetween permits only a small relative motion of the connector flex strip 32 before contact with the semicircular surface of the strain relief ridges 100 is established. Relative motion of connector flex strip 32 is thereby restricted to an extent that the orientation of its interface to connector 22 remains relatively unchanged when a force or pressure P presses against strain relief ridges 100 thereby closing the gap 160 therebetween.

In FIG. 11, a force or pressure P1 applied parallel to circuit board 20 presses connector flex strip 32 against strain relief ridges 100. Such a configuration is defined by a straightening or "squaring" of the curvature exhibited by connector flex strip 32 in its relaxed state. As illustrated, the surface of strain relief ridges 100 restricts extreme displacements of connector flex strip 32 and protects against kinking of and possible damage to the conductors therein.

Figure 12:
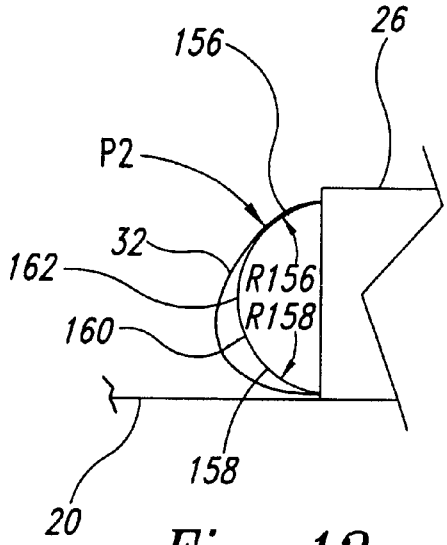
FIG. 12 is another illustration of the operation of strain relief ridges of the present invention.

FIG. 12 is another illustration of the strain relief ridges 100 wherein a force or pressure P2 is applied to connector flex strip 32 from a position above the strain relief ridges 100 and circuit board 20. In such instance, connector flex strip 32 is again distorted relative to its relaxed configuration, but the strain relief ridges 100 restricts the extent of motion available to connector flex strip 32, such that it retains its orientation relative to connector casing 26 at the extremes of the strain relief ridges 100. Thus, connector flex strip 32 is protected from kinking or damage.

FIG. 12 also illustrates a configuration of the strain relief ridges 100 wherein a non-curved strain relief surface 162 extends between two curved strain relief surfaces 156 and 158 thereby extending the potential effective length of the connector flex strip 32. Preferably, the radii are R156 and R158 of the respective curved strain relief surfaces 156 and 158 are chosen in combination with the length of flat strain relief surface 162 and the length of the connector flex strip 32 such that any externally applied pressure P1 and P2 distort the relaxed shape of the connector flex strip 32, yet protect it from kinking and from damage to the conductors thereof.

FIG. 13 is a top isometric view of the casing 26 with the electrical signal path subassembly 68 wrapped thereabout. A front edge 94 of the connector flex strip 32 is positioned under the plurality of retaining flanges 96 of the casing 26 and the notches 78 extending from the front flap 94 of the connector strip are engaged by the hooks 98, which firmly secures the front flap 94 within the recesses 95 behind flanges 96.

The connector flex strip 32 is folded across the bottom surface of the casing 26 and the strain relief ridges 100 on the backside thereof, as described above. The intermediate transfer board 50 coupling the individual shuttle flex strips 34 to the connector flex strip 32 is placed within the casing 26. The intermediate transfer board 50 is aligned with the casing 26 and the stiffener bar 52 within by a precise fit with the cavity in the casing 26 that holds the stiffener bar 52. The intermediate transfer board 50 is positioned inside of the casing 26 and pressed to fit down into the casing 26 on top of, and supported by the stiffening bar 52. Respective registration holes 76 and 102 within the connector flex strip 32 and the intermediate transfer board 50 are aligned with corresponding apertures 104 in stiffening bar 52 to accept the fasteners 42 therethrough.

Figure 14:
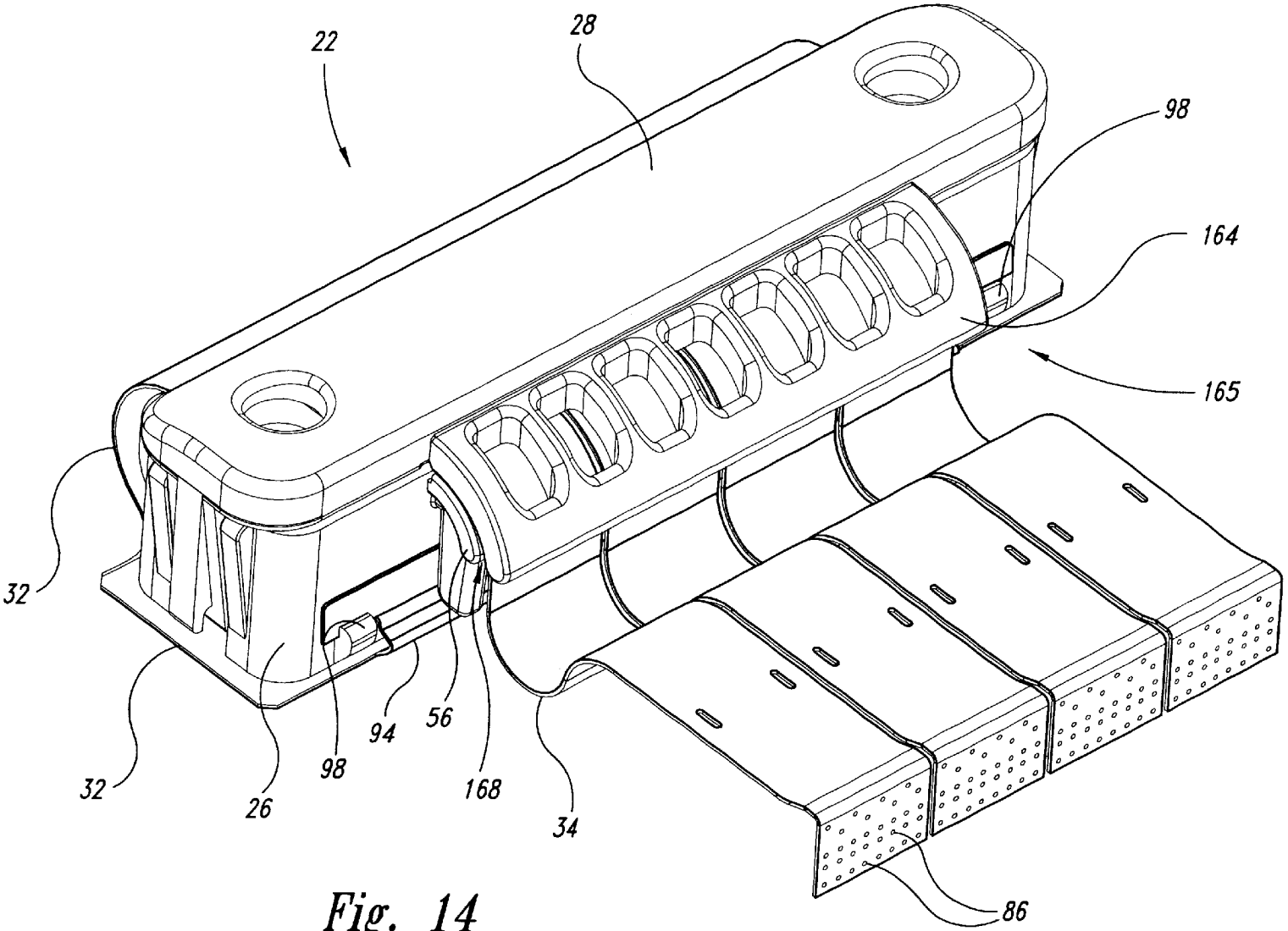
FIG. 14 is an isometric view of one embodiment of a connector assembly and shuttle flex strips of the present invention.

FIG. 14 illustrates an isometric view of a partial connector assembly 22 having a number of component parts. The lid 28 contains a top cowling 164 of the conductor guide 165. The case 26 includes a flex support 166 that cooperates with the top cowling 164 to form the conductor guide 165. See also FIGS. 8, 10, and 13. When the lid 28 is coupled to the casing 26, the top cowling 164 is spaced apart from the mating flex support 166 to form a curved channel 168 therebetween. The width of channel 168 is sized to permit flex strip 34 to pass therethrough. Individual shuttle flex strips 34 are thus held in a defined position with a predefined curvature the guide 165 as they exit from the connector assembly 22.

Each individual shuttle flex strip 34 contains a plurality of traces which carry the electrical signal lines provided on the connector flex strip 32 from the printed circuit board 20. The individual traces terminate in the electrodes 86 on the end portions of the shuttle flex strips 34. As described above, the various electrodes 86 are appropriately coupled to the shuttle 46 having the electrical connectors therein for coupling to mating connectors in the receiving assembly 36. The manner of coupling the electrodes 86 to an individual shuttle 46 is well-known in the art, and therefore is not described in detail herein. Any acceptable method of connection, including soldering, press-fit, alignment in a preset assembly, or any other suitable technique known in the art may be used.

Figure 15:
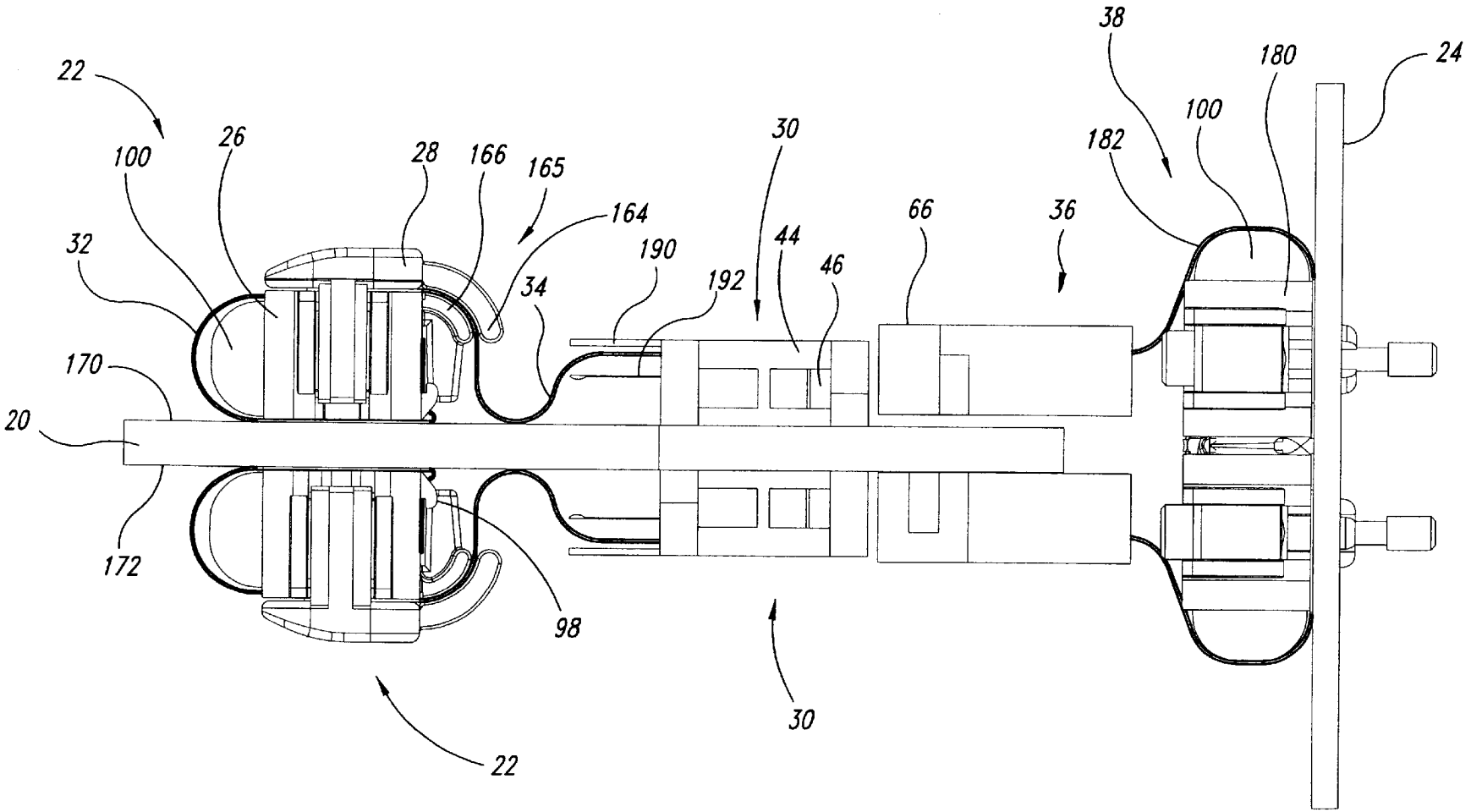
FIG. 15 is a side elevation view of the connector assembly of FIG. 2.
Figure 17:
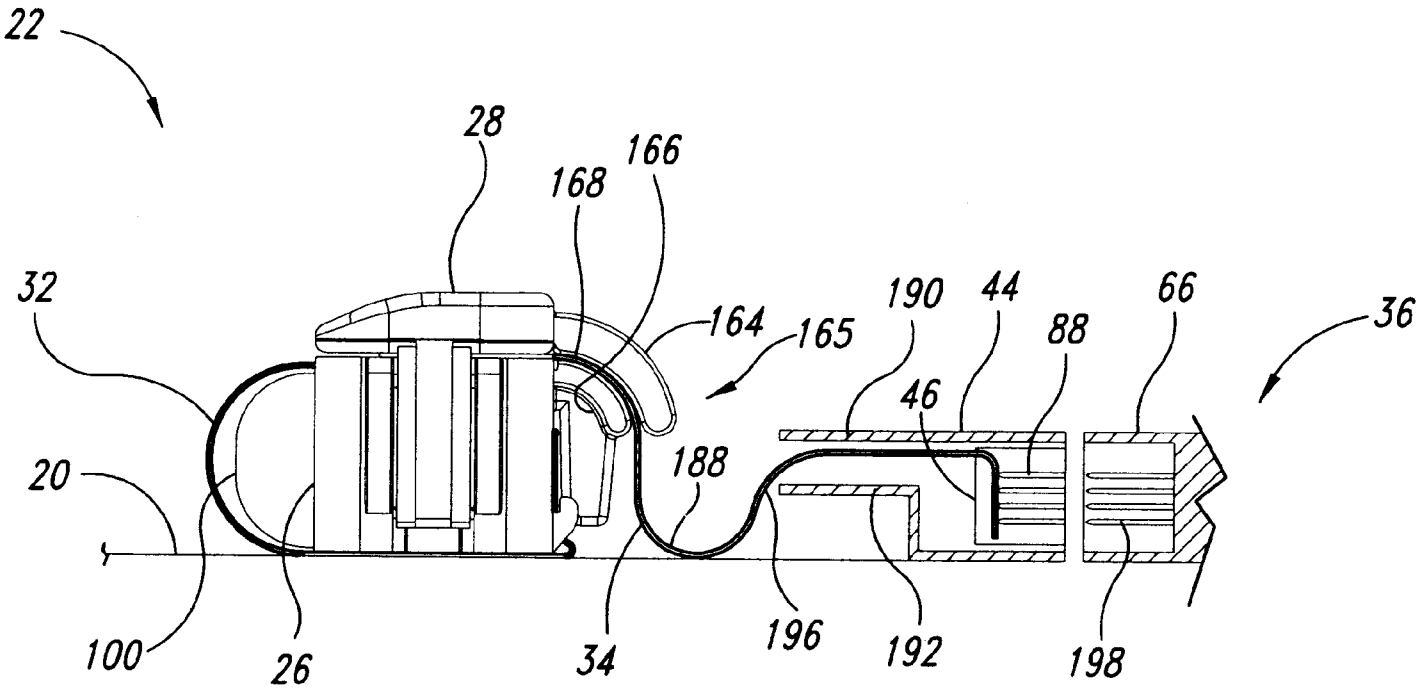
FIG. 17 is an enlarged, side view of the connector assembly of FIG. 16.
Figure 18:
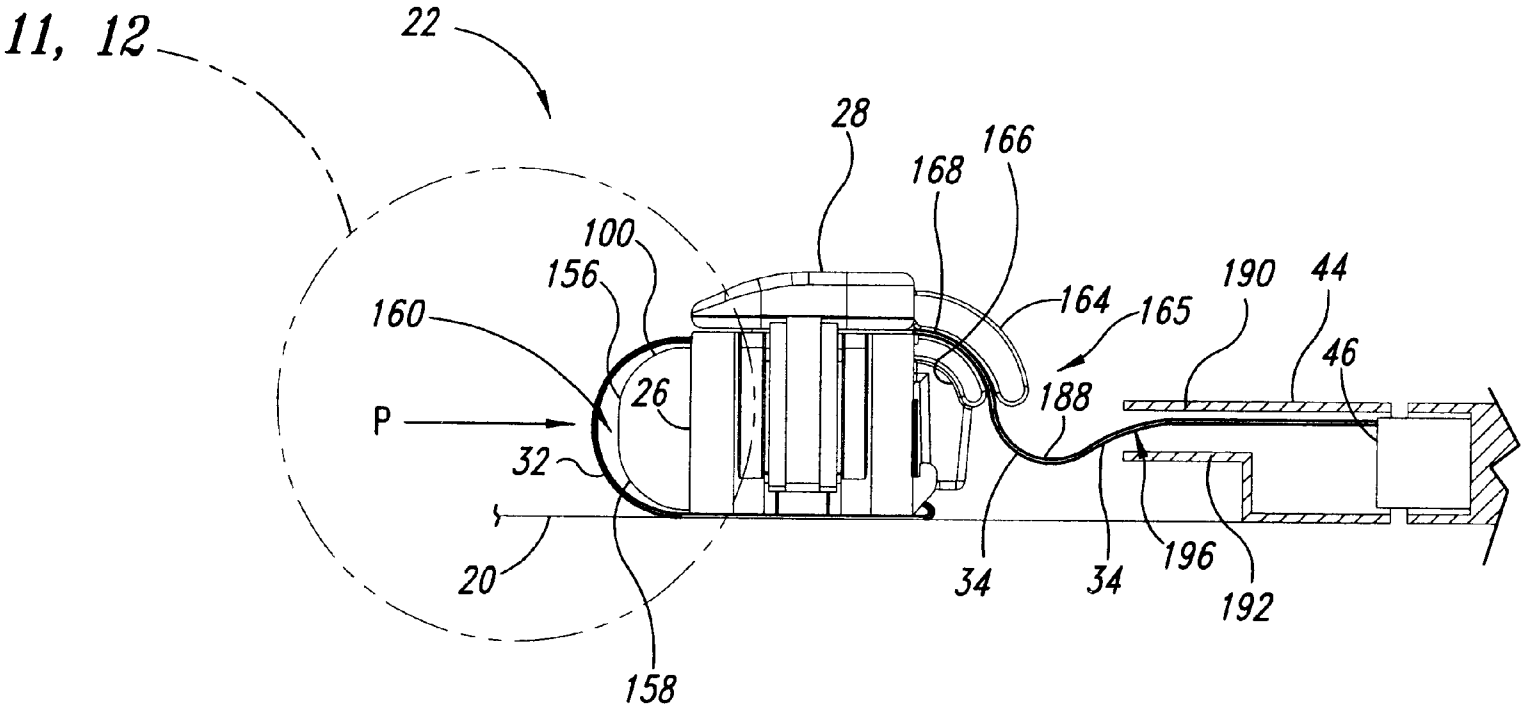
FIG. 18 is the side view of the connector assembly of FIG. 17 with the shuttle advanced for connection to the connector assembly.

FIG. 15 illustrates one embodiment of the invention showing a side view of the side plane electrical connector assembly in position for electrically coupling to the top plane electrical connector assembly 38. The side plane connector assembly 22 is mechanically and electrically coupled to circuit board 20 and includes signal path subassembly 68, which carries electrical signals between the circuit board 20 and the shuttle assembly 30. The shuttle assembly 30 includes a shuttle housing 44 having a plurality of individual shuttles 46 contained therein, as best shown in FIGS. 15, 17 and 18. As discussed in detail below, each individual shuttle 46 is slidably movable from a first position inside shuttle housing 44 to a second position in which it extends into the receiving assembly 36 and makes electrical connection therewith.

According to one embodiment of the present invention, a connector assembly 22 is provided on each side of the printed circuit board 20. The electrical traces on a first side 170 of the printed circuit board are coupled to the top plane printed circuit board 24 via the electrical connector 22 on the same side. Correspondingly, the electrical signal lines on the other side 172 of the printed circuit board 20 are carried to the top plane printed circuit board 24 via a second connector assembly 22 positioned on the other side 172. Since these two connector assemblies are identical, only one is numbered and described.

One advantage of the present invention is that the same connector assembly 22 can be used on both sides of the printed board with a common fastener extending therethrough for holding them in the correct position, and for providing proper alignment for carrying their respective electrical signals from the printed circuit board 20 to the top plane circuit board 24. Further, according to one embodiment of the present invention, the casing 26 of the connector assembly 22 is identical to the casing 180 of the top plane connector assembly 38. Having the casinos, and various parts of the connector assemblies identical to each other provides significant advantages in maintaining the inventory of parts and also in the assembly of the respective connectors.

As shown in FIG. 15, according to principles of the present invention, the connector assembly 22 includes the shuttle conductor guide assembly 165, which guides the shuttle flex strips 34 portion of the electrical signal path 68. The shuttle conductor guide assembly 165 is formed of the top cowling portion 164, which is coupled to and projects from the lid 28. The conductor guide assembly 165 also includes the flex support portion 166, which is part of the casing 26 and projects therefrom. The individual shuttle flex strips 34 extend through the channel 168 in the conductor guide 165 with a preset shape that ensures that the electrical traces on each individual flex strip 34 are protected and not damaged during handling, or when connecting the circuit boards to or disconnecting them from each other.

The connector flex strip 32 is connected at the bottom of the connector assembly 22, having exposed electrodes 72 which contact the surface 170 of the printed circuit board 20 and align with electrodes positioned on the printed circuit board 20. The signal lines are carried from the individual electrode terminals of the printed circuit board 20 to the individual traces within the connector flex strip 32. The attachment of the connector assembly 22 to the circuit board 20 also fixes the connector flex strip 32 in place relative to the circuit board 20. The connector flex strip 32 extends from the underside of the connector assembly 22 to the top, around support ridges 100. The curvature and shape of support ridges 100 is selected in combination with the length of connector flex strip 32 to provide a smooth, continuous curve of the connector flex strip 32. The support ridges 100 ensure that the flex strip 32 extends in a smooth, continuous curve and cannot be damaged during mounting or handling, as explained herein. The flex strip 32 has a plurality of delicate traces thereon which may be broken, or shorted out if the flex strip 32 is repeatedly twisted, bent or creased beyond the tolerances of operation. The support ridges 100 therefore ensure that the connector flex strip 32 is not bent or twisted so that the signal lines are reliably transferred from the printed circuit board 20 to the shuttle flex strips 34. Thus, the support ridges 100 ensure that the connector flex strip 32 provides reliable, long-term operation for the life of the computer.

The shuttle flex strips 34 carry the individual signal lines from the connector flex strip 32 into the shuttle assembly 30 and connect to each individual shuttle 46. A top cowling or guide bar 164 guides the shuttle flex strip into the shuttle assembly 30 and a cooperating bottom flex support or guide bar 166 maintains the flex strip 34 in the proper position as it enters the shuttle assembly 30. Within the shuttle housing 44, each flex strip 34 is mechanically and electrically connected to an individual shuttle 46 so that the electrodes are properly coupled for connection to the receiving assembly 36. In FIG. 15, the shuttle 46 is shown in the retracted position, so that the shuttle flex strip 34 is formed in a preset curvature as a function of the conductor guide 165. The individual shuttles 46 are advanced to enter the receiving assembly 36 and mate with individual electrode assemblies 66 within the receiving assembly 36. When the shuttle 46 is advanced, the individual shuttle flex strips 34 also advance, so that the slack shown in the curved portion is taken up. Upon retraction of the shuttle 46 into the shuttle housing 44, the flex strip 34 is again formed into its original the preset curvature.

The top plane printed circuit board 24 also includes, as part of the top plane electrical connector assembly 38, a connector casing 180 having one or more support ridges 100 formed thereon. A connector flex strip 182 extends from the bottom side of the connector assembly 38, around the support ridges 100 and into the receiving assembly 36. According to one embodiment, the casing 180 of the receiving connector assembly 38 is identical to the casing 26 of the connector assembly 22. In another embodiment, the bottom, top, and back side are the same, but the front side is different and does not contain the shuttle conductor guide assembly 165. The underside, exposed surface of the connector flex strip 182 for the top plane printed circuit board has exposed electrodes thereon which are aligned with exposed electrodes on the printed circuit board 24 for carrying the signal path to the electrical traces found in the printed circuit board 24.

Figure 16:
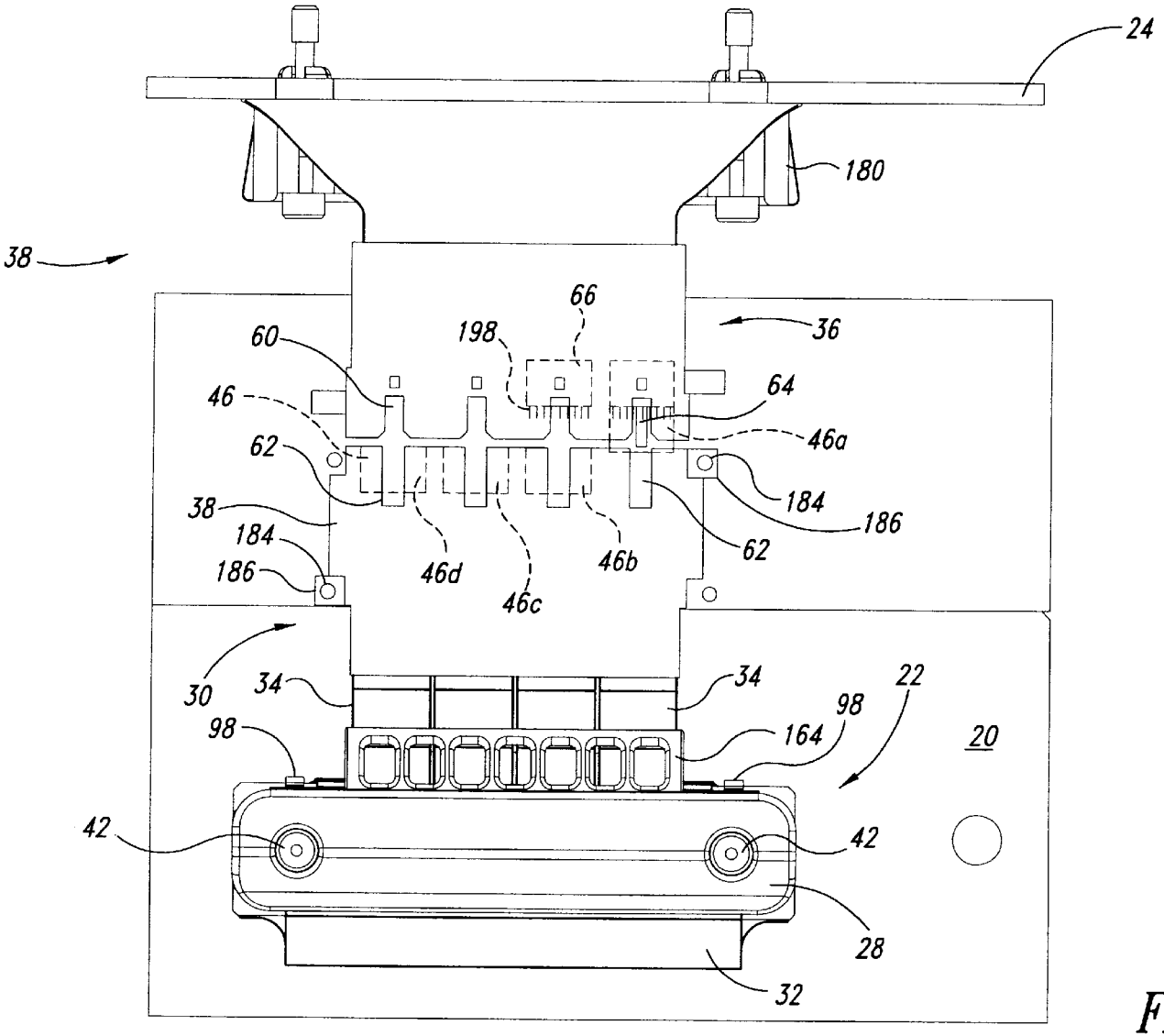
FIG. 16 is a top plan view of the connector assembly of FIG. 2.

FIG. 16 is a plan view of the connector assembly of the invention. The shuttles 46 are electrical connectors configured for mating with electrical connectors in the receiving housing 36. For example, the shuttles 46 are equipped with receptacles that are electrical connectors along an interior wall thereof. Each individual receptacle in the shuttle 46 is coupled to one of the electrodes 86 of one of the shuttle flex strips 34, as illustrated in FIGS. 9, 13 and 14. Thus, each receptacle contains an electrical signal line transferred from the printed circuit board 20 via the electrical connector flex strip 32 and the shuttle flex strips 34.

The shuttle housing 44 is preferably rigidly connected to the printed circuit board 20 via fasteners 184 which extend through brackets 186 projecting from the shuttle housing 44. The individual shuttle members 46 are movable within the housing 44, and are advanced into the receiving housing 36 so as to provide the electrical connection from the signal lines carried in the shuttle flex strips 34 to the receiving assembly 38. The receiving housing 36 includes a connector assembly 66 configured for mating with electrical connectors in the shuttles 46. For example, in an embodiment wherein the shuttles are equipped with electrically conductive female receptacles, the connector assembly 66 is equipped with a plurality of mating pins 198. The pins 198 are electrically conductive male members which extend into the mating female receptacles within the shuttle 46.

As shown in FIG. 16, each individual shuttle 46 includes a tab 64 for properly aligning the shuttle 46 in either the shuttle housing 44 or the receiving housing 36, depending upon the position of the individual shuttle 46. The shuttle housing 44 includes the slotted aperture 62 in which the tab 64 is positioned when the shuttle 46 is within the shuttle housing 44. The receiving slot 60 is positioned inside the receiving housing 36 into which the tab 64 is inserted when the shuttle 46 is advanced and positioned within the receiving assembly 36. FIG. 16 shows a first shuttle 46*a* in the electrically connected position inserted into the receiving assembly 36. For purposes of illustration, the other shuttles 46*b*, 46*c* and 46*d* are shown within the shuttle housing 44, rather than advanced into the receiving housing 36.

FIG. 17 is an enlarged view of connector assembly 22 and receiver housing 36, with shuttle flex strip 34 extending between them. Conductor guide 165 includes top cowling portion 164 and flex support 166 portion extending from the connector assembly 22 toward the shuttle assembly 30 and circuit board 20. Top cowling 164 and flex support 166 are configured with respective convex and concave surfaces, which are mutually coextensive and spaced apart about the thickness of shuttle flex strip 34. The arching track or channel 168 defined by spaced apart surfaces of conductor guide portions 164 and 166 is configured to capture flexible conductor strip 34 and direct it substantially perpendicularly toward circuit board 20. An inherent stiffness of shuttle flex strip 34 causes it to follow the path provided by channel 168 toward the circuit board 20 in a substantially straight line. The inherent stiffness also causes flex strip 34 to bend in a smooth arch 188 at its intersection with circuit board 20. Interconnection with shuttle 46 perpendicular to its exit track from conductor channel 168 inverts the curve 188 and causes flex strip 34 to arch smoothly toward shuttle 46. According to the embodiment described in FIG. 6, additional conductor guides 190 and 192 project from shuttle housing 44 toward connector assembly 22 and form a second channel 194 that urges shuttle flex strip 34 into second preset bend 196. Thus, when shuttle 46 is its first pre-insertion position, shuttle flex strip 34 extends from the channel 168 between the first and second conductor guide portions 164 and 166 and forms a compound U-shaped curve with its convex surface facing away from conductor guide 165 towards circuit board 20. A leg of the U-shaped curve bends in a smooth arch into the track defined by the second channel 194 formed by conductor guide portions 190 and 192 on shuttle housing 44, which is perpendicular to the first leg of the U extending from channel 168 formed by conductor guide 165. Preferably, each of conductor guide portions 164 and 166 are formed with rounded lips at the end of the channel 168 they define. The rounded lips protect shuttle flex strip 34 from sharp edges that could cut through the lamination or damage the conductors.

Figure 6:
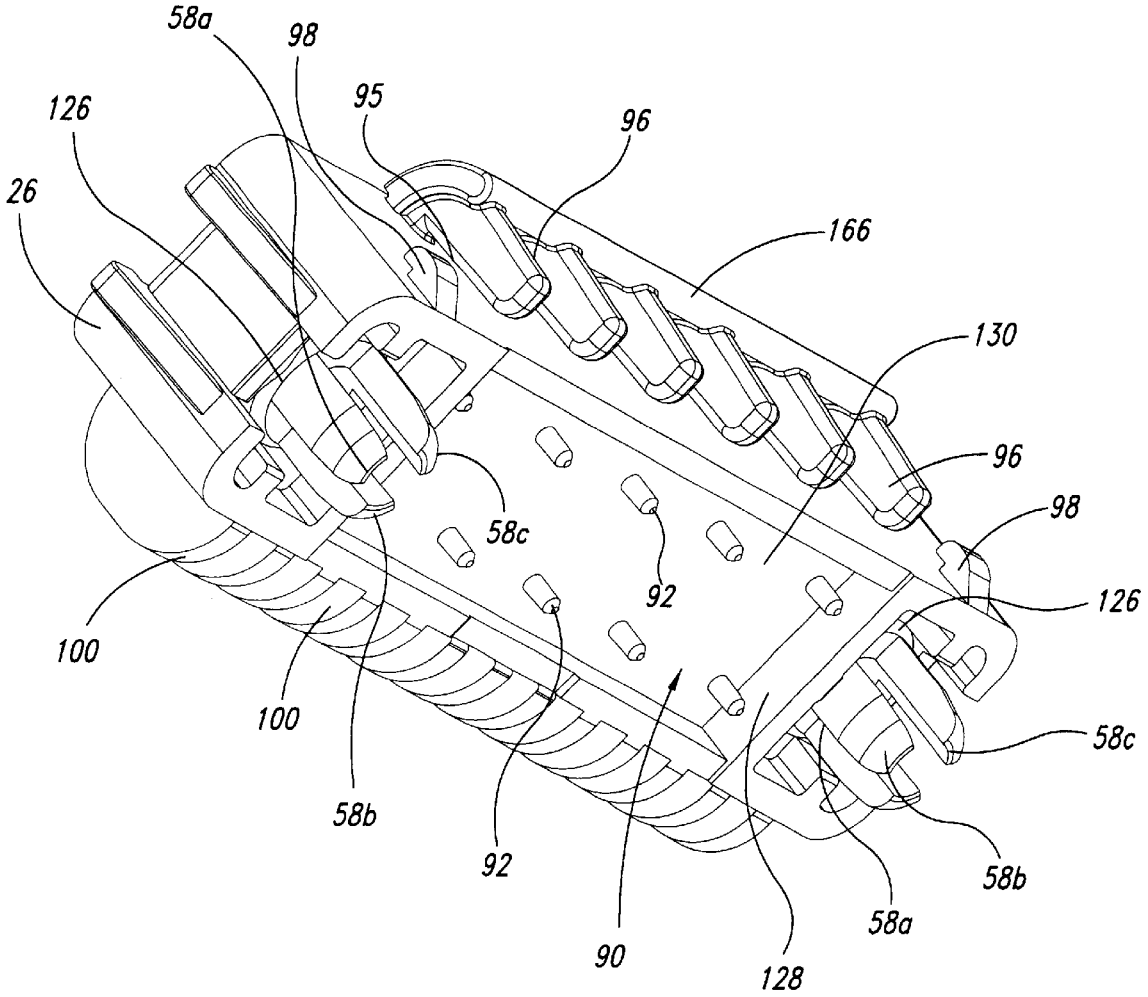
FIG. 6 is a bottom isometric view one embodiment of the casing of the present invention.

The connector 66 has a number of pins 198, as can be seen in FIG. 6. The shuttle 46 includes the receptacles 88 that receive the pins 198 when the shuttle advances and provide electrical connection between the traces on the flexible shuttle strip 34 and the pins 198.

FIG. 18 illustrates shuttle flex strip 34 in an extended configuration when shuttle 46 is in a second position inserted into mating connector 66. The curvature of shuttle flex strip 34 is substantially straightened when shuttle 46 is inserted into mating connector 66, but preset bends 188 and 196 are maintained with their respective original sense or direction of curvature. Although preset bends 188 and 196 are substantially flatter, each retains its original direction of curvature so that the convex and concave nature of each remains unchanged relative to conductor guide 165 of connector assembly 22 and to shuttle 46. As will be appreciated by those of skill in the art, any acceptable electrical connector assemblies can be used between the shuttle housing 44 and a receiving housing 36.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An electrical connector comprising:

a rigid casing adapted for mounting on an electrical device;

an elongated flexible electrical conductor having a plurality of exposed electrodes at either end thereof and interconnected by corresponding electrical traces, a first set of the exposed electrodes adjacent one end of the conductor oriented with respect to one surface of the rigid casing;

a resilient pressure pad positioned between the casing and the first set of electrodes;

a positionable shuttle having a plurality of electrical contacts with each of the contacts coupled to one of the exposed electrodes adjacent another end of the signal path; and an electrical conductor guide defining a channel extending from the casing and projecting toward the positionable shuttle and the one surface of the rigid casing adjacent to the first set of the exposed electrodes at one end of the signal path, including first and second cooperating guide portions defining the channel between them.

2. The electrical connector according to claim 1, wherein the rigid casing further comprises a rigid stiffener bar joined to a relatively flexible casing.

3. The electrical connector according to claim 1, further comprising a shuttle housing slidably engaging the shuttle between two opposing surfaces thereof.

4. The electrical connector according to claim 1, wherein:

the casing further comprises a plurality of alignment prongs projecting from the one surface adjacent to the first set of the exposed electrodes; and the electrical conductor further comprises a plurality of registration holes oriented with respect to the first set of the exposed electrodes adjacent one end thereof and sized to mate with the alignment prongs.

5. The electrical connector according to claim 1, further comprising a plurality of rounded support ridges projecting from a surface of the casing between the one surface of the casing having the first set of exposed electrodes adjacent thereto and a second surface of the casing opposite the one surface.

6. The electrical connector according to claim 1, wherein:

one of the first and second cooperating guide portions further comprises a cowling portion projecting from the lid; and another of the first and second cooperating guide portions further comprises a support member projecting from the casing adjacent to the lid.

7. The electrical connector according to claim 1, further comprising a lid clamped to the casing; and wherein the conductor further comprises:

a first flexible electrical conductor having the first set of the exposed electrodes adjacent one end and a plurality of exposed electrodes adjacent another end thereof;

a second flexible electrical conductor having the shuttle coupled thereto and a plurality of exposed electrodes adjacent another end thereof; and a circuit board coupling the exposed electrodes at the end of the first conductor opposite from the first set of exposed electrodes and the exposed electrodes at the end of the second conductor opposite from the shuttle, the circuit board clamped between the lid and the casing.

8. The electrical connector according to claim 7, further comprising a second resilient pressure pad positioned between the lid and the circuit board.

9. The electrical connector according to claim 8, further comprising a plurality of second flexible electrical signal paths each having a shuttle coupled thereto and a plurality of exposed electrodes adjacent another end thereof.

10. A connector assembly comprising:

an elongate connector casing comprising a recess formed in a first surface thereof;

an elongate and flexible conductor strip having a plurality of electrically conductive traces coupling electrodes at a first end thereof to electrodes at a second end thereof, which are oriented relative to the first surface of the casing;

a compression pad, partially encased in the recess, and fixed between the electrodes at the second end of the flexible conductor strip and the first surface of the casing;

a substantially rigid stiffener bar at least partially encased in the connector casing, the stiffener bar providing stiffness and alignment of the connector casing to the flexible conductor strip; and a plurality of apertures for receiving fasteners for extending through the connector casing and through the stiffener bar to provide a united, rigid connector assembly.

11. The connector assembly recited in claim 10, wherein the casing further comprises an alignment prong projecting from the first surface thereof; and the flexible conductor strip further comprises a registration hole oriented relative to the electrodes at the second end thereof, the registration hole sized to register the electrodes with the alignment prong.

12. The connector assembly of claim 10 wherein the elongate connector casing comprises a support ridge projecting from a second surface thereof and a conductor guide projecting from a third surface thereof, and wherein the flexible conductor strip is looped over the support ridge and partially encased within the conductor guide.

13. The connector assembly of claim 10 wherein:

the connector casing has a first tolerance in its physical dimensions;

the stiffener bar has a second tolerance in its physical dimensions, the second tolerance being tighter than the first tolerance so that the combined assembly of the connector casing and stiffener bar has an alignment tolerance that is more precise than the tolerance of the connector casing alone.

14. A connector, comprising:

a plastic casing having a cavity and having first and second casing apertures passing from within the cavity to an outside surface of the casing;

a circuit board having first and second apertures;

a rigid bar sized to fit snugly within the cavity, the bar having first and second bar apertures at first and second ends of the bar, respectively, the bar apertures positioned to align with the casing apertures;

first and second alignment posts on the outside surface of the casing and integral therewith, positioned at first and second ends of the casing;

first and second fasteners, each of the fasteners configured, at a first and thereof, to engage the bar at a respective bar aperture, and pass through a respective one of the first and second casing apertures and through corresponding respective board apertures in the circuit board to engage a fastening member on a side of the circuit board opposite the casing, to draw the bar and casing toward the circuit board; and an electrical conductor strip positioned between the casing and the circuit board which is held in electrical contact with the circuit board by the combination of the casing, the bar and the fasteners.

15. The connector of claim 14, wherein the electrical conductor strip includes a plurality of contacts on a surface facing the circuit board, and further including first and second conductor apertures configured and positioned to mate with the first and second alignment posts, respectively, and maintaining, thereby, a positional relationship between the plastic casing, the conductor and the circuit board such, that the features on the casing bear against the electrical conductor strip directly opposite each of the plurality of contacts thereon, and that the each of the plurality of contacts on the conductor make electrical contact with the respective one of the plurality of contacts on the circuit board.

16. The connector of claim 14 wherein the features on the outside surface of the casing comprise a resilient member configured to bear against the first surface of the conductor, opposite the plurality of contacts on the conductor.

17. The connector of claim 14, further comprising a fastening member, the fastening member including:

a second plastic casing substantially identical to the first plastic casing, including features configured to bear against a first surface of a second flexible conductor, causing a plurality of contacts on a second surface thereof to make electrical connections with respective ones of a plurality of contacts on a second surface of the circuit board;

a second rigid bar substantially identical to the first rigid bar; and third and fourth alignment posts, substantially identical to the first and second alignment posts, respectively, the first and fourth alignment posts configured to interlock with each other while mating, from opposing sides of the circuit board, with the first board aperture, and the second and third alignment posts configured to interlock with each other while mating, from opposing sides of the circuit board, with the second board aperture;

and wherein the first and second fasteners are configured, at second ends thereof, to pass through and engage third and fourth bar apertures, respectively, in the second metal bar.

* * * * *